US010460657B2

(12) United States Patent
Nakatani

(10) Patent No.: US 10,460,657 B2
(45) Date of Patent: Oct. 29, 2019

(54) EL DISPLAY DEVICE AND METHOD FOR DRIVING EL DISPLAY DEVICE

(71) Applicant: JOLED INC., Tokyo (JP)

(72) Inventor: Toshikuni Nakatani, Tokyo (JP)

(73) Assignee: JOLED INC., Tokyo (JP)

( * ) Notice: Subject to any disclaimer, the term of this patent is extended or adjusted under 35 U.S.C. 154(b) by 311 days.

(21) Appl. No.: 14/902,101

(22) PCT Filed: Jun. 5, 2014

(86) PCT No.: PCT/JP2014/002995
§ 371 (c)(1),
(2) Date: Dec. 30, 2015

(87) PCT Pub. No.: WO2015/001709
PCT Pub. Date: Jan. 8, 2015

(65) Prior Publication Data

US 2016/0372035 A1 Dec. 22, 2016

(30) Foreign Application Priority Data

Jul. 5, 2013 (JP) ..... 2013-142167

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0842* (2013.01);
(Continued)

(58) Field of Classification Search
CPC ..... G09G 2330/028; G09G 2310/0262; G09G 3/3233; G09G 2330/045; G09G 2330/021;
(Continued)

(56) References Cited

U.S. PATENT DOCUMENTS 6,028,578 A * 2/2000 Ota ..... G09G 3/3648 345/94
7,397,452 B2 7/2008 Nakamura
(Continued)

FOREIGN PATENT DOCUMENTS

JP 10-111490 4/1998
JP 2002-132218 5/2002
(Continued)

OTHER PUBLICATIONS

International Search Report (ISR) from International Searching Authority (Japan Patent Office) in International Pat. Appl. No. PCT/JP2014/002995, dated Sep. 2, 2014.

*Primary Examiner* — Patrick N Edouard
*Assistant Examiner* — Douglas M Wilson
(74) *Attorney, Agent, or Firm* — Greenblum & Bernstein, P.L.C.

(57) ABSTRACT

An EL display device includes a display screen; a first gate signal line; a second gate signal line; gate driver ICs (circuits); a current generating circuit which supplies a current to EL elements; a current amount obtaining circuit which obtains a magnitude of a current flowing through a plurality of pixels; and an on-voltage generating circuit which generates a control voltage output by the gate driver IC (circuit) to the first gate signal line. Each of the pixels includes a first switching transistor. The control voltage is a voltage which causes the first switching transistor to be in a conducting state. The on-voltage generating circuit varies a first control voltage based on an output result from the current amount obtaining circuit.

13 Claims, 20 Drawing Sheets

(52) U.S. Cl.
CPC ..... *G09G 2300/0861* (2013.01); *G09G 2310/0256* (2013.01); *G09G 2310/0262* (2013.01); *G09G 2320/029* (2013.01); *G09G 2320/0214* (2013.01); *G09G 2320/041* (2013.01); *G09G 2330/00* (2013.01); *G09G 2330/021* (2013.01); *G09G 2330/025* (2013.01); *G09G 2330/028* (2013.01); *G09G 2330/045* (2013.01); *G09G 2360/16* (2013.01)

(58) Field of Classification Search
CPC ..... G09G 3/3266; G09G 2360/16; G09G 2310/0256; G09G 2320/029; G09G 2320/041; G09G 2330/025; G09G 2330/00
See application file for complete search history.

(56) References Cited

U.S. PATENT DOCUMENTS

| | | | | |
|---|---|---|---|---|
| 7,518,577 | B2 | 4/2009 | Akimoto et al. | |
| 7,683,860 | B2 | 3/2010 | Nagao et al. | |
| 8,259,042 | B2 | 9/2012 | Tada et al. | |
| 9,262,965 | B2 * | 2/2016 | Chaji | G09G 3/3233 |
| 2005/0110720 | A1 | 5/2005 | Akimoto et al. | |
| 2005/0116914 | A1 | 6/2005 | Nagao et al. | |
| 2005/0237002 | A1 * | 10/2005 | Nakamura | G09G 3/3233 315/169.3 |
| 2006/0284802 | A1 * | 12/2006 | Kohno | G09G 3/3225 345/76 |
| 2007/0080905 | A1 * | 4/2007 | Takahara | G09G 3/3233 345/76 |
| 2007/0176861 | A1 | 8/2007 | Tada et al. | |
| 2011/0234925 | A1 * | 9/2011 | Tatara | G09G 3/3233 348/800 |
| 2015/0279272 | A1 | 10/2015 | Takahara | |

FOREIGN PATENT DOCUMENTS

| | | |
|---|---|---|
| JP | 2005-156697 | 6/2005 |
| JP | 2005-202365 | 7/2005 |
| JP | 2007-147866 | 6/2007 |
| JP | 2007-298778 | 11/2007 |
| JP | 2008-089684 | 4/2008 |
| JP | 2010-145446 | 7/2010 |
| JP | 2010-145580 | 7/2010 |
| WO | 2004/064030 | 7/2004 |

* cited by examiner

EL DISPLAY DEVICE AND METHOD FOR DRIVING EL DISPLAY DEVICE

TECHNICAL FIELD

The present disclosure relates to a video display method and a display device for displaying TV images and the like on a display panel including, for example, organic electroluminescent elements (hereinafter, the organic electroluminescence may be referred to as EL or OLED). The present disclosure also relates to a video display system, a video display method, and a display device suitable for displaying stereoscopic images.

BACKGROUND ART

Patent Literature (PTL) 1 discloses an EL display device including EL elements. The EL display device controls a current flowing through each EL element by decreasing an on-resistance of a transistor to be written into a driving transistor. With this, display luminance and current consumption of the EL display device can be reduced.

CITATION LIST

Patent Literature

[PTL 1] Japanese Unexamined Patent Application Publication No. 2010-145446

SUMMARY OF INVENTION

Technical Problem

An object of the present disclosure is to provide an EL display device which can reduce degradation of EL elements resulting from an overheated display panel, and maintain an excellent display quality with less decrease in image quality.

Solution to Problem

An EL display device according to an aspect of the present disclosure includes: a display screen including a plurality of pixels arranged in rows and columns; a first gate signal line and a second gate signal line which are disposed for each of the rows of the plurality of pixels; a gate driver circuit which outputs a first control voltage to the first gate signal line and a second control voltage to the second gate signal line; a current generating circuit which supplies a current to the plurality of pixels of the display screen; a current amount obtaining circuit which obtains a magnitude of a current flowing through the plurality of pixels; and a control voltage generating circuit which generates the first control voltage output by the gate driver circuit to the first gate signal line. Each of the plurality of pixels includes: an EL element; a driving transistor which supplies a driving current to the EL element; a first switching transistor disposed in a path of the driving current, the first switching transistor having a voltage applied across a channel and adjusted based on the first control voltage supplied from the first gate signal line; and a second switching transistor which switches between a conducting state and a non-conducting state based on the second control voltage supplied from the second gate signal line, the second switching transistor applying a video signal to the driving transistor. The control voltage generating circuit adjusts a magnitude of the first control voltage based on an output result from the current amount obtaining circuit.

Advantageous Effects of Invention

According to the present disclosure, it is possible to provide an EL display device which can reduce degradation of EL elements resulting from an overheated display panel, and maintain an excellent display quality with less decrease in image quality.

DESCRIPTION OF EMBODIMENTS

Hereinafter, embodiments will be described in detail with reference to the drawings where necessary. Note, however, that excessively detailed descriptions may be omitted. For example, detailed descriptions of well-known aspects or repetitive descriptions of substantially identical configurations may be omitted. This is to facilitate understanding by a person of ordinary skill in the art by avoiding unnecessary verbosity in the subsequent description.

(Underlying Knowledge Forming the Basis of the Present Disclosure)

Underlying knowledge forming the basis of the present disclosure is described below prior to describing details of the present disclosure.

An active-matrix (hereinafter, may be referred to as AM) organic EL display device including organic EL elements arranged in rows and columns has been employed as a display panel for, for example, a smart phone, and has been commercialized. Each EL element includes an EL layer between an anode electrode (terminal) and a cathode electrode (terminal). The EL element emits light in response to a current or a voltage supplied to the anode electrode (terminal) and the cathode electrode (terminal). Accordingly, the EL element has characteristics in which the display luminance is proportional to current consumption and an increase in display luminance increases the current consumption.

Accordingly, an increase in display luminance increases power consumption. An increase in power consumption causes the panel to generate heat, which results in degradation of the EL elements and the like.

In order to solve such a problem, a method is available which varies the power supply voltage of a driving transistor.

Figure 1:
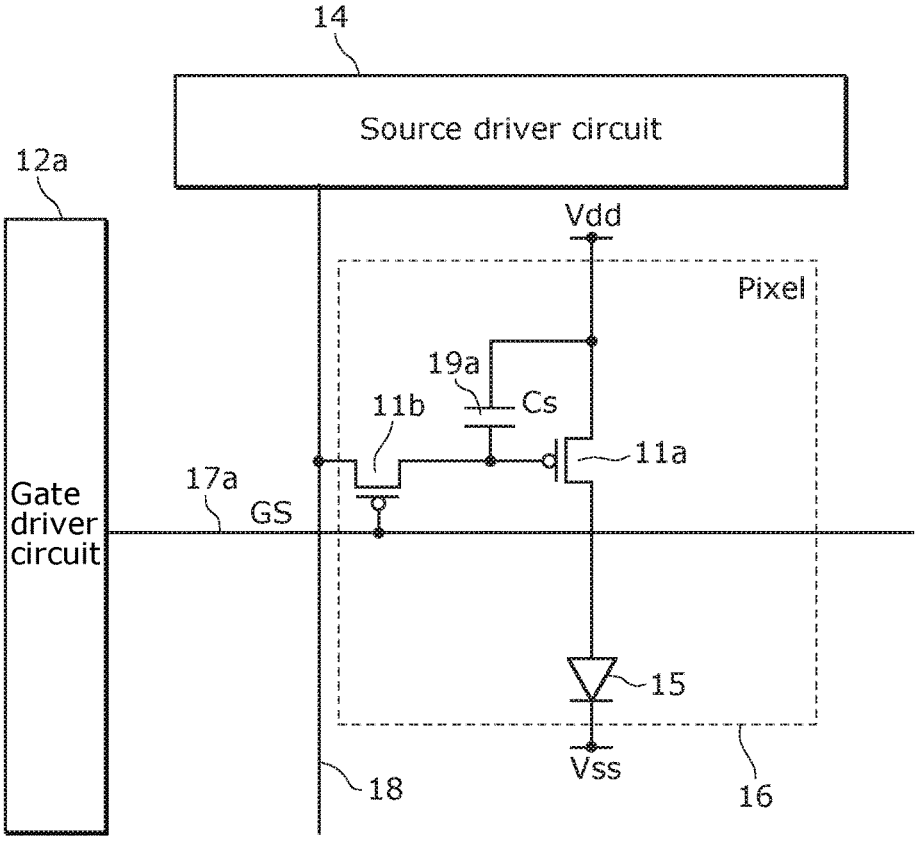
FIG. 1 illustrates an EL display device according to a technique forming the basis of the present disclosure.

FIG. 1 illustrates an EL display device according to a technique forming the basis of the present disclosure.

FIG. 1 illustrates an example of a pixel circuit of an organic EL element.

A pixel circuit 16 includes, as a basic configuration, a light-emitting element (EL element) 15, a driving transistor 11*a* which drives the EL element 15, and a switching transistor 11*b* which applies a video signal to the driving transistor 11*a*. The drain side of the driving transistor 11*a* is connected to a voltage source Vdd (such as a power supply device) of the EL element 15. The Vdd is an anode voltage. The light emission luminance of the EL element 15 can be adjusted by causing the driving transistor 11*a* and the switching transistor 11*b* to control a current Id of the EL element 15.

There is a potential difference between the voltage source Vdd and the EL element 15 in the pixel circuit in FIG. 1 (the potential difference Vdd across a channel of the driving transistor 11*a*). Hence, heat is generated in the driving transistor 11*a* due to power loss which corresponds to power=current (Id)×voltage (Vdd−a potential difference across the EL element−Vss). This rapidly degrades the characteristics of the EL element 15 adjacent to the driving transistor 11*a*.

In order to reduce heat generation of the driving transistor 11*a*, power loss may be reduced by detecting a current Id flowing through the EL element 15, varying the voltage of the voltage source Vdd, and decreasing the current Id. However, this causes a problem of degrading the display quality (uneven luminance and flicker) due to uneven characteristics of the driving transistors 11*a* which drive the EL elements 15. Moreover, although the on-resistance of the transistor which writes a signal to the driving transistor 11*a* may be varied, the rate of variation is so small and produces little effect.

Hereinafter, a pixel circuit and a display panel which can reduce degradation of the EL characteristics and achieve a high display quality will be described. In the following description, the term transistors 11 refers to the driving transistor 11*a*, and switching transistors 11*h*, 11*c*, and 11*d*.

Embodiment 1

Hereinafter, an EL display device according to Embodiment 1 will be described with reference to FIG. 2 to FIG. 12.

[1-1. Configuration of EL Display Device]

An EL display device according to the present disclosure has a feature in which the current of each EL element 15 is controlled by a control transistor (switching transistor 11*d*) different from the driving transistor 11*a* which applies a current to the EL element 15. The on-characteristics of the switching transistor 11*d* are controlled by varying the voltage applied to the gate of the switching transistor 11*d*, and the current of the EL element 15 is controlled via the driving transistor 11*a*. Accordingly, the EL driving current can be controlled without reducing the display quality due to uneven characteristics of the driving transistors 11*a*. Additionally, heat generation of the entire EL pixel circuit can be reduced, which can prevent the characteristics of the EL element from degrading due to the heat generation.

In the present disclosure, the drawings include omitted, magnified or reduced portions to facilitate understanding or creation of the drawings.

The matters and content illustrated in the drawings or described in this embodiment of the Description according to the present disclosure are also applicable to other embodiments. The EL display panel illustrated in the drawings or described in this embodiment disclosed herein is applicable to EL display devices according to the present disclosure.

For example, of course, as an EL display device 151 of a laptop personal computer in FIG. 20 to be described later, one of the EL display devices (EL display panels) illustrated in the drawings or described in this embodiment of the present disclosure can be employed or employed to form an information apparatus.

Parts assigned with the same numbers or symbols have identical or similar forms, materials, functions or operations, relevant matters, perform identical or similar actions, or provide identical or similar effects.

The details illustrated in the drawings etc. can be combined with other embodiments etc. even when no such indication is provided. For example, it is possible to form an information display device illustrated in FIG. 18, FIG. 19, or FIG. 20 to be described later, by adding a touch panel etc. to the EL display panel illustrated in FIG. 2 according to the present disclosure.

The EL display device according to the present disclosure may conceptually include system apparatuses such as information apparatuses. The EL display panels may conceptually include system apparatuses such as information apparatuses in a broad sense.

Although the driving transistors and the switching transistors are described as thin-film transistors in the present disclosure, the driving transistors and the switching transistors according to the present disclosure are not limited to the thin-film transistors. Thin-film diodes (TFD), ring diodes and the like can be used to form the same.

The driving transistors and the switching transistors are not limited to such thin-film elements, but also may be transistors formed on a silicon wafer. For example, a transistor may be firstly formed using a silicon wafer, and removed and transferred onto a glass board. Moreover, for example, a display panel on which a transistor chip formed using a silicon wafer is mounted by bonding on a glass substrate is exemplified.

As a matter of course, the transistors according to the present disclosure may be field effect transistors (FETs), metal-oxide-semiconductor (MOS) FET, MOS transistors, or bi-polar transistors. Those transistors are also basically thin-film transistors. Additionally, the transistors may be, of course, varistors, thyristors, ring diodes, photodiodes, photo transistors, PLZT elements, etc.

It is preferable that the transistors according to the present disclosure include a lightly doped drain (LDD) structure, irrespective of whether each transistor is an N-channel transistor or a P-channel transistor.

Furthermore, the transistors may be any one of those formed using: high-temperature polycrystalline silicon (HTPS); low-temperature polycrystalline silicon (LTPS); continuous grain silicon (CGS); transparent amorphous oxide semiconductors (TAOS, IZO); amorphous silicon (AS); and infrared rapid thermal annealing (RTA).

Figure 2:
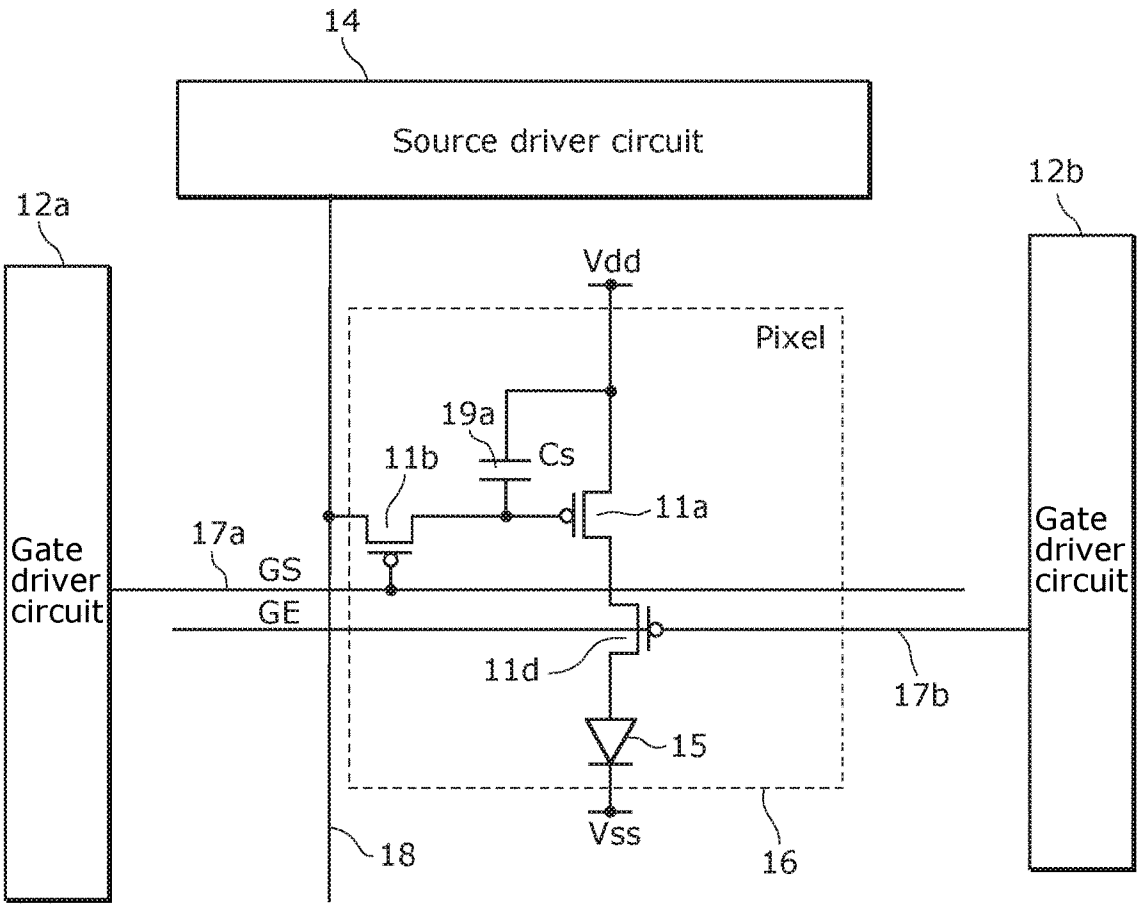
FIG. 2 illustrates a pixel configuration of an EL display device according to the present disclosure.

In FIG. 2, transistors (the driving transistor 11*a* and the switching transistors 11*b* and 11*d*) included in the pixel 16 are all P-channel transistors. However, in the present disclosure, the transistors (the driving transistor 11*a* and the switching transistors 11*b* and 11*d*) in the pixel 16 are not limited to the P-channel transistors. The transistors may include only N-channel transistors or each may include both the N-channel and P-channel transistors. Moreover, the driving transistor 11*a* may include both the P-channel and N-channel transistors.

The switching transistors 11*b* and 11*d* are not limited to transistors, but may be analog switches each including both the P-channel and N-channel transistors, for example.

It is preferable that the transistors each have a top gate structure. This is because the top gate structure decreases parasitic capacitance, and a gate electrode pattern of the top gate functions as a light shielding layer to shield light emitted from the EL element 15, making it possible to reduce malfunction of the transistor or an off-leakage current.

It is preferable, in the process to be carried out, that a copper line or a copper alloy line can be employed as a line material for gate signal lines 17*a* and 17*b* or a source signal line 18, or for both the gate signal lines 17*a* and 17*b* and the source signal line 18. This is because it is possible to decrease wiring resistance of signal lines (the gate signal lines 17*a* and 17*b* or the source signal line 18) and a larger EL display panel can be implemented.

It is preferable that the gate signal lines 17*a* and 17*b* which are driven (controlled) by gate driver ICs (gate driver circuits) 12 (12*a* and 12*b*) have low impedance. Accordingly, it is also preferable that the compositions or structures of the gate signal lines 17*a* and 17*b* have low impedance.

In particular, it is preferable that LTPS is employed. The LTPS can be used to form transistors having a top gate structure and a small parasitic capacitance and of N channel and P channel. The copper line or the copper alloy line process can be employed in processes. It is preferable that a three-layer structure of Ti—Cu—Ti is employed for the copper line.

For the lines, it is preferable that a three-layer structure of Mo (molybdenum)-Cu—Mo is employed in the case of transparent amorphous oxide semiconductors (TAOS).

Figure 3:
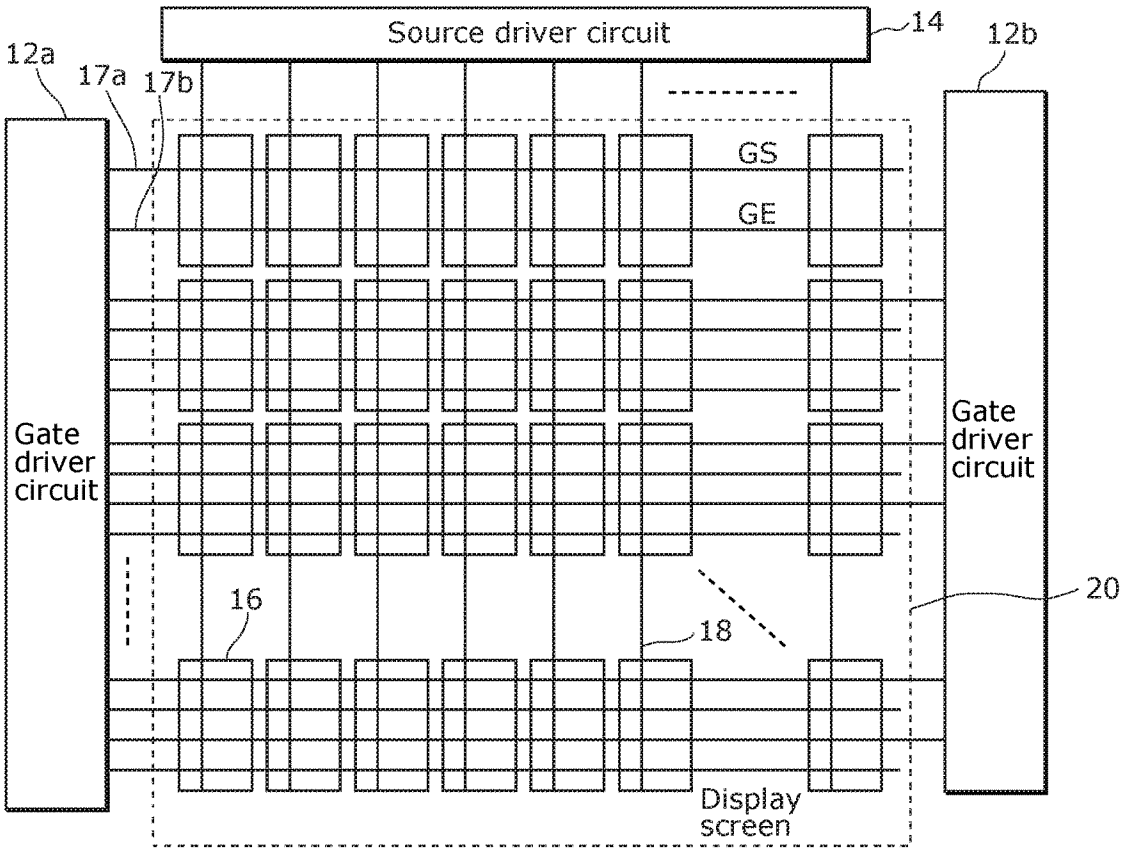
FIG. 3 illustrates a configuration of the EL display device according to the present disclosure.

FIG. 2 and FIG. 3 each illustrate a pixel configuration of an EL display apparatus according to the present disclosure. The EL display device according to Embodiment 1 includes a display screen 20 including a plurality of EL elements 15. As peripheral circuits of the display screen 20, the EL display device includes: a gate driver IC (circuit) 12*a* which drives the gate signal lines 17*a*; a gate driver IC (circuit) 12*b* which drives the gate signal lines 17*b*; a source driver IC (circuit) 14 which generates and outputs a video signal; and a control circuit 70 (see FIG. 6) which controls the gate driver ICs (circuits) 12*a* and 12*b*, the source driver IC (circuit) 14 and the like.

Each gate signal line 17*a* is referred to as a gate signal line GS, and each gate signal line 17*b* is referred to as a gate signal line GE. The switching transistor 11*b* has a gate terminal connected to the gate signal line 17*a*. The switching transistor 11*d* has a gate terminal connected to the gate signal line 17*b*.

As FIG. 3 illustrates, the display screen 20 includes the EL elements 15 arranged in a matrix. The display screen 20 displays an image based on a video signal externally input to the EL display device.

The transistors included in the pixel 16 are P-channel transistors. The driving transistor 11*a* generates a current to be supplied to the EL element 15. The switching transistor 11*b* applies, to the driving transistor 11*a* of the pixel 16, a video signal generated by the source driver IC (circuit) 14 and applied to the source signal line 18.

The switching transistor 11*d* is disposed or formed in the path of the line through which a driving current to the EL element 15 flows. The path refers a path through which a driving current flows. The switching transistor 11*d* may be positioned anywhere between an anode Vdd terminal and a cathode Vss terminal. Turning on the switching transistor 11*d* causes the current from the driving transistor 11*a* to be supplied to the EL element 15. The EL element 15 emits light in proportional to the current supplied to the EL element 15. Turning off the switching transistor 11*d* stops the supply of the current to the EL element 15, thereby stopping the light emission of the EL element 15.

A capacitor 19*a* includes an electrode serving as a first electrode connected to the gate terminal of the driving transistor 11*a*, and a second electrode connected to the source terminal of the driving transistor 11*a*.

The capacitor 19*a* holds a voltage corresponding to the signal voltage supplied from the source signal line 18. For example, after the switching transistor 11*b* is turned off, the capacitor 19*a* stably holds the potential between the gate and source electrodes of the driving transistor 11*a*, and stabilizes the current supplied to the EL element 15 from the driving transistor 11*a*.

In Embodiment 1 of the present disclosure, the switching transistor 11*d* is used in a linear region, and is also used in a non-linear region. Switching between the linear region and the non-linear region is controlled by a gate voltage applied to the gate terminal of the switching transistor 11*d*.

The EL element 15, the driving transistor 11*a*, and the switching transistor 11*d* are disposed between the anode electrode (terminal or line) and the cathode electrode (terminal or line). The EL element 15, the driving transistor 11*a*, and the switching transistor 11*d* are connected in series.

Increasing the on-voltage applied to the gate terminal of the switching transistor 11*d* causes the switching transistor 11*d* to be in an on state at a high level and to operate in a saturated region. The voltage across the channel (between the source and the drain) of the switching transistor 11*d* decreases. Accordingly, a sufficient voltage is applied to the EL element 15 and across the channel of the driving transistor 11*a*. Hence, a constant current from the driving transistor 11*a* is supplied to the EL element 15.

Decreasing the on-voltage applied to the gate terminal of the switching transistor 11*d* increases the on-resistance across the channel of the switching transistor 11*d* (the switching transistor 11*d* operates in a linear region). An increase in the on-resistance across the channel (between the source and the drain) of the switching transistor 11*d* increases the voltage across the channel of the switching transistor 11*d*. Accordingly, a voltage is unlikely to be applied across the channel of the driving transistor 11*a* and to the EL element 15. Hence, a current supplied to the EL element 15 by the driving transistor 11*a* is decreased.

As described above, according to the present disclosure, when a current supplied to the EL element 15 is to be decreased, the on-voltage applied to the gate terminal of the switching transistor 11*d* is decreased, and the resistance across the channel of the switching transistor 11*d* is increased.

Figure 7:
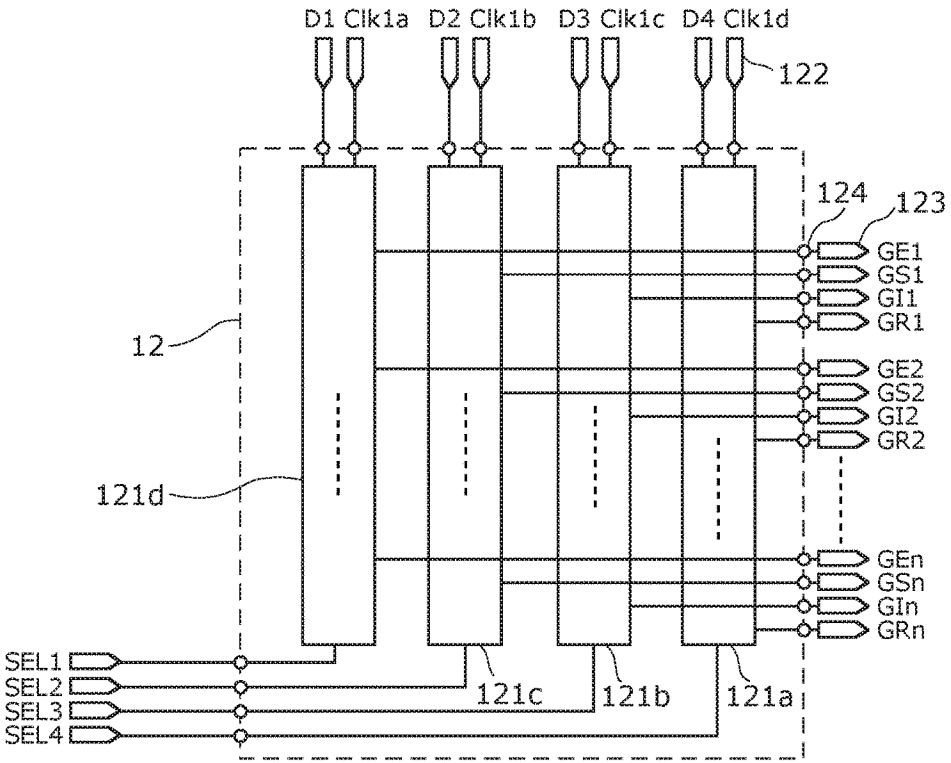
FIG. 7 illustrates a configuration of a gate driver IC (circuit) in the EL display device according to the present disclosure.

The gate driver ICs (circuits) 12*a* and 12*b* each include a plurality of scanning and output buffer circuit 121*a*, 121*b*, and 121*c* (see FIG. 7). The gate driver IC (circuit) 12*a* is connected to each gate signal line 17*a*, and the gate driver IC (circuit) 12*b* is connected to each gate signal line 17*b*. The gate driver ICs (circuits) 12*a* and 12*b* are driving circuits which have functions of controlling conduction (on) and non-conduction (off) of the switching transistors 11*b* and 11*d* of the pixel 16 by outputting selection signals to the gate signal lines 17*a* and 17*b*, respectively.

In the EL display device according to the present disclosure, the gate driver TCs (circuits) 12*a* and 12*b* are respectively disposed on the left and right sides of the display screen 20. At least the gate signal lines 17 of each pixel 16 are connected to the gate driver IC (circuit) 12*a* or the gate driver IC (circuit) 12*b*. In FIG. 2 and FIG. 3, the gate signal line 17*a* (gate signal line GS) is connected to the gate driver IC (circuit) 12*a*, and is connected to the gate terminal of the switching transistor 11*b*. The gate signal line 17*b* (gate signal line GE) is connected to the gate driver IC (circuit) 12*b*, and is connected to the gate terminal of the switching transistor 11*d*.

The EL display device according to one aspect of the present disclosure includes: a display screen including a plurality of pixels arranged in rows and columns; the gate signal lines 17 (the gate signal lines 17*a* and 17*b*) disposed for each pixel row of the display screen; the source signal line 18 disposed for each pixel column of the display screen; the gate driver circuits (gate driver ICs) 12*a* and 12*b* which respectively drive the gate signal lines 17*a* and 17*b*; and the source driver IC (source driver circuit) 14 which drives the source signal lines 18.

The gate driver ICs (circuits) 12*a* and 12*b* output selection signals having a first pulse and a second pulse. The source driver IC (circuit) 14 outputs or generates a video signal corresponding to an input image.

In the EL elements 15, non-light emitting state sequentially starts on a per-row basis of the EL elements 15 based on the first pulse of the selection signals input via the gate signal lines 17*a* and 17*b*. Based on the second pulse of the selection signals, a video signal (light emission data) is written from the source signal line 18. The video signal is held in the capacitor 19*a* of the pixel 16. The driving transistor 11*a* generates a light emission current (EL current) Id based on the video signal held in the capacitor 19*a*. The light emission current Id is supplied to the EL element 15 by the switching transistor 11*d* being turned on by the first pulse.

The driving circuit unit supplies the selection signal and the video signal to the gate signal lines 17*a* and 17*b* and the source signal line 18 such that writing of light emission data to the first row of the EL elements 15 starts before the non-light emitting state in the last row of the EL elements 15 starts and writing of the light emission data into the last row of the EL elements 15 ends after the light-emitting state starts in the first row of the EL elements 15.

As described above, the EL display device according to Embodiment 1 is capable of performing current control on the EL element 15 using a control transistor (the switching transistor 11*d*) different from the driving transistor 11*a* which applies a current to the EL element 15. The on-characteristics of the switching transistor 11*d* are controlled by varying the voltage applied to the gate of the switching transistor 11*d*, and the current of the EL element 15 is controlled via the driving transistor 11*a*. Accordingly, the EL driving current can be controlled without reducing the display quality resulting from uneven characteristics of the driving transistors 11*a*. Additionally, heat generation of the entire EL pixel circuit can be reduced, and degradation of the characteristics of the EL elements resulting from the heat generation can be prevented.

[1-2. Operation of EL Display Device]

Next, an operation (a driving method) of the EL display device according to Embodiment 1 will be described.

Figure 4:
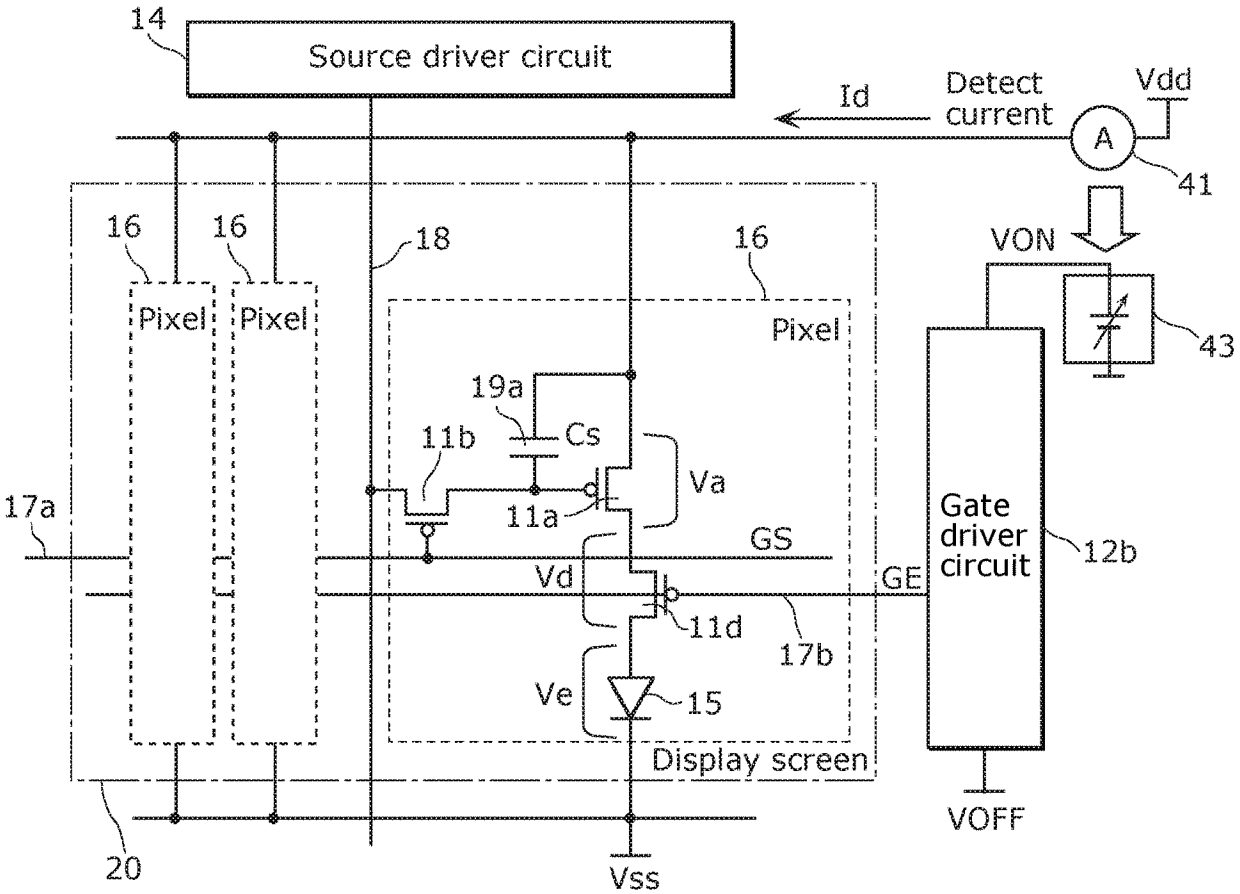
FIG. 4 illustrates a pixel configuration in the EL display device according to the present disclosure.

FIG. 4 illustrates a pixel configuration of the EL display device according to Embodiment 1.

In the present disclosure, as FIG. 4 illustrates, a magnitude of a current flowing through the display screen 20 is detected by a current detecting circuit 41. The current detecting circuit 41 detects the magnitude of at least one of (i) a current flowing through the anode Vdd and (ii) a current flowing through the cathode Vss. The current detecting circuit 41 may detect not only the magnitude of the current but also a variation in the magnitude of the current or the variation rate. In FIG. 4, the current detecting circuit 41 is disposed in the anode line or terminal. The current detecting circuit 41 corresponds to the current amount obtaining circuit according to the present disclosure.

In FIG. 4, an on-voltage generating circuit 43 has at least one of (i) a function of generating an on-voltage (Von) and (ii) a function of varying the on-voltage. The on-voltage generating circuit 43 corresponds to a control voltage generating circuit according to the present disclosure.

The on-voltage (Von) is supplied to the gate driver IC (circuit) 12*b*, and the on-voltage is output to the gate signal line 17*b* (gate signal line GE).

In FIG. 4, the switching transistor 11*d* is a P-channel transistor. Accordingly, the on-voltage is a negative voltage. An off-voltage is a positive voltage.

The EL element 15, the driving transistor 11*a*, and the switching transistor 11*d* are disposed between the anode electrode (terminal or line) and the cathode electrode (terminal or line). The EL element 15, the driving transistor 11*a*, and the switching transistor 11*d* are connected in series.

The switching transistor 11*d* operates in a saturated region when the switching transistor 11*d* is in an on state at a high level. The voltage across the channel (between the source and the drain) of the switching transistor 11*d* decreases. Accordingly, a sufficient voltage is applied to the EL element 15 and across the channel of the driving transistor 11*a*. Hence, a constant current from the driving transistor 11*a* is supplied to the EL element 15.

A decrease in the on-voltage applied to the gate terminal of the switching transistor 11*d* increases the on-resistance across the channel (between the source and the drain) of the switching transistor 11*d* (the switching transistor 11*d* operates in a linear region). An increase in the on-resistance across the channel of the switching transistor 11*d* increases the voltage across the channel of the switching transistor 11*d*. Accordingly, a voltage is unlikely to be applied to the EL element 15 and across the channel of the driving transistor 11*a*. Hence, a current supplied to the EL element 15 by the driving transistor 11*a* is decreased.

With a decrease in the on-voltage applied to the gate terminal of the switching transistor 11*d*, the voltage Vd across the channel of the switching transistor 11*d* decreases. Accordingly, a sufficient voltage is applied to the EL element 15 and across the channel of the driving transistor 11*a*, which facilitates the flow of the current to the EL element 15.

With an increase in the on-voltage, the voltage Vd across the channel of the switching transistor 11*d* increases. Accordingly, a voltage is unlikely to be applied across the channel of the driving transistor 11*a*, and the voltage Ve is unlikely to be applied to the EL element 15. This makes a current to be unlikely to flow into the EL element (a current flow to the EL element is decreased). A decrease in the current flowing through the EL element 15 leads to less power consumed by the display screen. Additionally, since less heat is generated by the display screen, degradation of the EL elements 15 and the transistors 11 is reduced.

As described above, the voltage Vd across the channel of the switching transistor 11*d* can be varied by varying or adjusting the on-voltage applied to the gate terminal of the switching transistor 11*d*.

The anode terminal voltage and the cathode terminal voltage can be divided into the voltage Va across the channel of the driving transistor 11*a*, the voltage Vd across the channel of the switching transistor 11*d*, and the voltage Ve across the terminals of the EL element 15.

Varying the on-voltage of the gate signal line 17*b* varies the voltage Vd across the channel of the switching transistor 11*d*. Since the cathode voltage Vss and the anode voltage Vdd each are a constant voltage, a variation in the Vd varies the voltage Va across the channel of the driving transistor 11*a* and the voltage Ve across the terminals of the EL element 15. Accordingly, varying the voltage Vd can vary the current flowing through the EL element 15. A variation in the current of the EL element 15 leads to a variation in the current flowing through the display screen 20. Accordingly, the current flowing through the display screen 20 can be varied by varying the on-voltage.

The characteristics of the driving transistors 11*a* vary due to problems in manufacturing processes or the like. Likewise, the characteristics of the EL elements 15 vary due to problems in manufacturing processes or the like. The variations in the characteristics of the driving transistors 11*a* and the EL elements 15 cause, for example, stripe unevenness on the display screen 20, leading to a reduction in the display quality.

As a conventional method for decreasing a current flowing through the display screen 20, the anode voltage or the cathode voltage may be varied. For example, in order to decrease a current flowing through the display screen 20, it is sufficient that the anode voltage Vdd is decreased. A decrease in the anode voltage Vdd can decrease the current flowing through the display screen 20. However, since the anode voltage Vdd is a common voltage in the display screen 20, the decrease in the anode voltage Vdd is directly reflected on the variations in the characteristics of the EL elements 15 and the driving transistors 11*a*. Hence, stripe unevenness is displayed. This leads to a reduction in the display quality. Varying the anode voltage Vdd or the cathode voltage Vss which are common in the display screen 20 also varies the brightness of the display screen. Accordingly, flicker is caused on the display screen 20 based on the variation in the voltage Vdd or the variation in the voltage Vss.

In the present disclosure, the voltage Vd across the channel of the switching transistor 11*d* is varied by varying the on-voltage applied to the gate terminal of the switching transistor 11*d* disposed in the current path of the driving transistor 11*a*.

The variation in the Vd is divided appropriately, based on the characteristics of the driving transistor 11*a* and the EL element 15, into the voltage Va across the channel of the driving transistor 11*a* and the voltage Ve across the terminals of the EL element 15. The voltage division is carried out according to the variations in the characteristics of the driving transistors 11*a* and the EL elements 15. The characteristics of the driving transistors 11*a* and the EL elements 15 vary in a certain degree within the display screen 20. Accordingly, even if the on-voltage of the switching transistor 11*d* is varied, stripe unevenness and the like resulting from the characteristics of the transistors and the like occur dispersedly across the display screen 20, or the occurrence is reduced. Hence, as in the case where the anode voltage Vdd or the cathode voltage Vss which are common in the display screen 20 is decreased (varied), occurrence of stripe unevenness is reduced and flicker is also not caused.

In the present disclosure, as FIG. 4 illustrates, the current detecting circuit (unit) 41 detects the current Id flowing through the display screen 20 and the on-voltage generated by the on-voltage generating circuit 43 is varied based on the magnitude of the detected current or the variation rate of the current. The variation in the on-voltage varies the current flowing through the display screen 20.

In the present disclosure, for example, the current detecting circuit 41 detects when the current flowing through the display screen 20 increases or when the current flowing through the display screen 20 exceeds a predetermined value, and the on-voltage generating circuit 43 is controlled based on the detected or measured current or the data proportional to the current. The on-voltage generating circuit 43 varies the on-voltage applied to the gate terminal of the switching transistor 11*d* so as to increase the voltage Vd across the channel of the switching transistor 11*d* (so as to increase the on-resistance of the switching transistor 11*d*). As a result, the current flowing through the EL element 15 is decreased.

In the present disclosure, the current detecting circuit 41 detects, for example, when the current flowing through the display screen 20 decreases or when the current flowing through the display screen 20 becomes below a predetermined value, and the on-voltage generating circuit 43 is controlled based on the detected or measured current or the data proportional to the current. The on-voltage generating circuit 43 varies the on-voltage applied to the gate terminal of the switching transistor 11*d* so as to decrease the voltage Vd across the channel of the switching transistor 11*d* (so as to decrease the on-resistance of the switching transistor 11*d*). As a result, control is performed such that the current flowing through the EL element 15 increases and light emission is provided with higher peak luminance.

Figure 5:
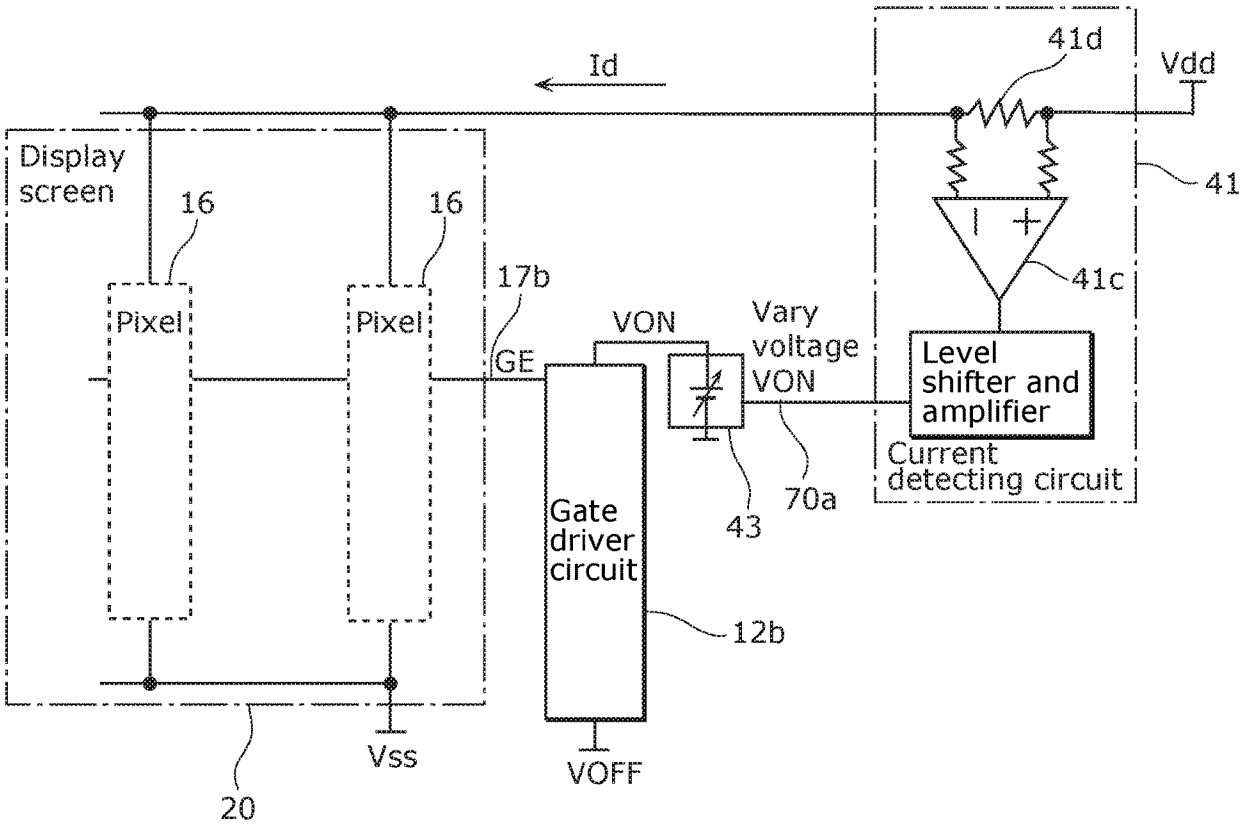
FIG. 5 illustrates a pixel configuration in the EL display device according to the present disclosure.

FIG. 5 illustrates a configuration of the EL display device according to Embodiment 1 with more detailed current detecting circuit 41.

Figure 9:
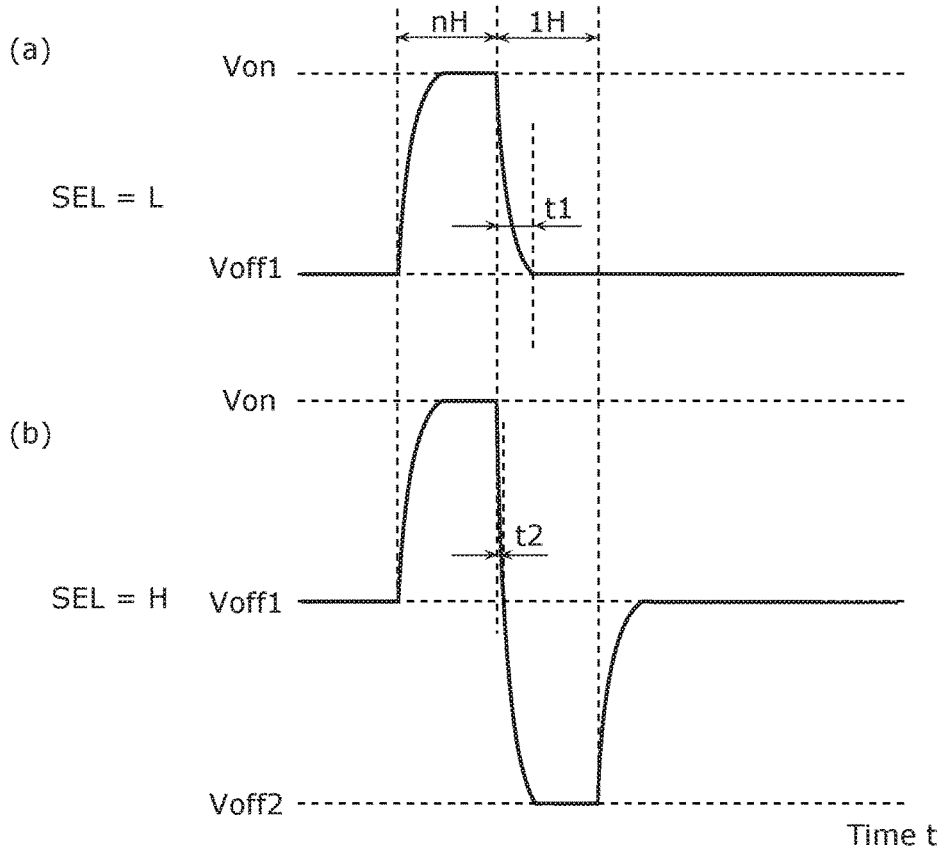
FIGS. 9(*a*) and (*b*) illustrate two-value voltage drive and three-value voltage drive in the case of an N-channel transistor.

The gate driver circuit (IC) 12*b* (see FIG. 5) outputs voltages Von, Voff1, and Voff2 (see FIG. 9). The on-voltage generating circuit 43 includes a feedback (FB) control line 70*a* for on-voltage adjustment (see FIG. 5). The on-characteristics (the on-resistance and the voltage Vd across the channel) of the control transistor (switching transistor) 11*d* of the gate driver IC (circuit) 12*b* can be varied by varying the voltage of the on-voltage generating circuit 43 serving as the on-voltage of the control transistor (switching transistor) 11*d* using the FB control line 70*a*.

In other words, when the on-voltage serving as a power supply voltage applied to the gate driver IC (circuit) 12*b* is increased, the gate driver IC (circuit) 12*b* outputs an on-voltage to the gate signal line 17. This also increases the on-voltage. Accordingly, the on-voltage applied to the gate terminal of the switching transistor 11*d* also increases. Additionally, the on-voltage serving as a power supply voltage applied to the gate driver IC (circuit) 12*b* also decreases. Accordingly, the on-voltage output by the gate driver IC (circuit) 12*b* to the gate signal line 17*b* also decreases. As described above, the on-voltage applied to the gate terminal of the switching transistor 11*d* can be, for example, varied by adjusting, varying, setting or the like the on-voltage serving as a power supply voltage of the gate driver IC (circuit) 12*b*. Accordingly, it is possible to perform current control on the EL element 15.

When the switching transistor (control transistor) 11*d* is an n-type transistor, an increase in the on-voltage of the switching transistor 11*d* decreases the on-resistance of the switching transistor 11*d*, and the value of current flowing through the EL element 15 increases.

On the other hand, a decrease in the on-voltage of the switching transistor 11*d* increases the on-resistance of the switching transistor 11*d*, and the value of current flowing through the EL element 15 decreases. When the switching transistor 11*d* is a p-type transistor, of course, the switching transistor 11*d* operates in a manner reverse to that of an n-type transistor.

With this, the current of the EL element 15 can be controlled by an increase or a decrease (levels) of the on-voltage of the switching transistor 11*d* and the like. This allows the current detecting circuit 41 to detect the current value Id of the voltage source Vdd (for example, a power supply) of the EL element 15. By providing feedback to the on-voltage, the EL element current of the entire panel can be controlled.

With the above-described current control of the EL element, a voltage is divided appropriately between the switching transistor 11*d*, the driving transistor 11*a* and the EL element 15 which are present between the voltage source Vdd of the anode side of the EL element 15 and the voltage source Vss of the cathode side of the EL element 15. Accordingly, the variations in the characteristics of the driving transistors 11*a* and the EL elements 15 are not displayed on the display screen 20. Flicker is not caused on the display screen 20 unlike the case where the anode voltage Vdd is varied.

The display screen 20 includes the current detecting circuit 41 (see FIG. 5). The current detecting circuit 41 is connected in series to the path of the panel current (EL element current) Id which corresponds to a sum of the current flowing through the EL elements 15 within the display screen 20. The current detecting circuit 41 is connected to the on-voltage generating circuit 43 so as to control the Von which is the on-voltage of the switching transistor 11*d*.

As FIG. 5 illustrates, the current detecting circuit 41 is disposed between the voltage source Vdd and the switching transistor 11*d*. The current detecting circuit 41 includes: a current detecting resistor 41*d*; and a differential amplifier 41*c* (see FIG. 6) for detecting the voltage generated across the current detecting resistor 41*d* due to the EL element current Id. The differential amplifier 41*c* generates a voltage value obtained by amplifying the EL element current Id by a given amount according to the current Id. The switching element (transistor) 41*b* and an amplifier 41*a* adjust the level of the voltage generated by the differential amplifier 41*c* so as to match the FB control line 70*a* of the on-voltage generating circuit 43 in a subsequent stage.

An increase in the EL element current Id increases the output voltage of the amplifier 41*a*, and a decrease in the EL element current Id decreases the output voltage of the amplifier 41*a*.

The amplifier 41*a* is connected to a feedback circuit (the FB control line 70*a*) of the on-voltage generating circuit 43, and adjusts the on-voltage of the on-voltage generating circuit 43 such that the EL element current Id does not exceed a given value.

Figure 6:
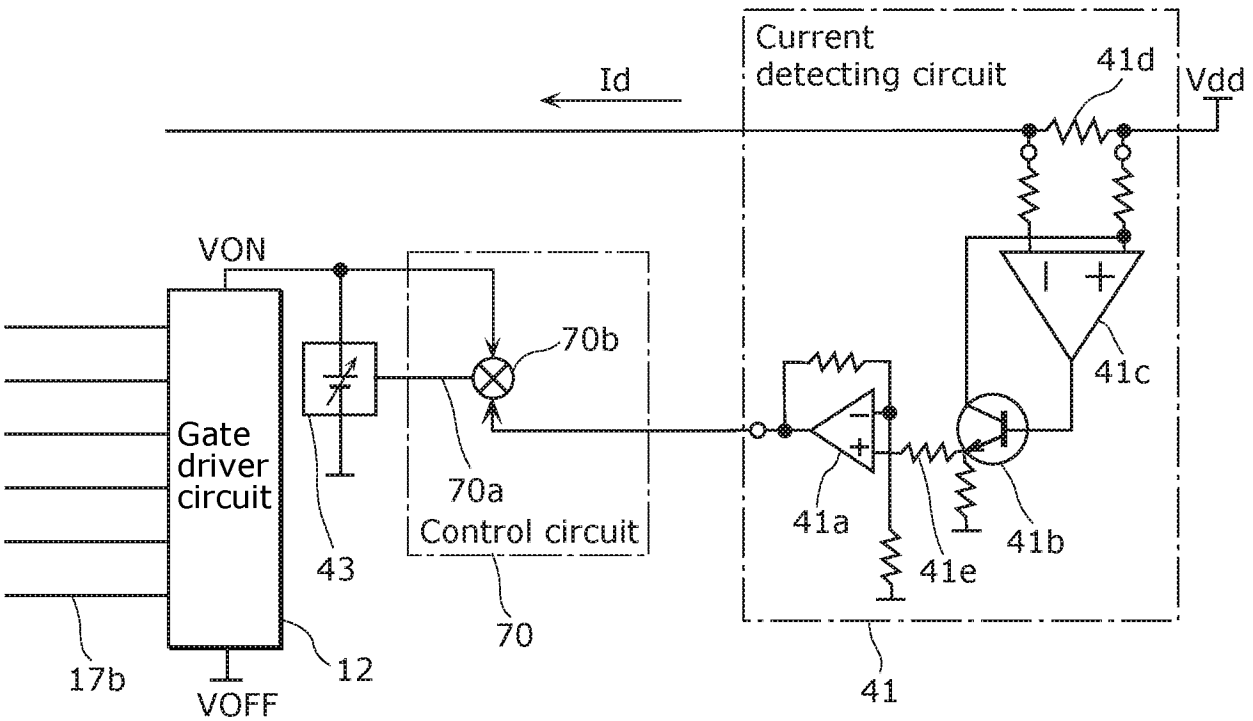
FIG. 6 illustrates a pixel configuration in the EL display device according to the present disclosure.

When the FB control line 70*a* of the on-voltage generating circuit 43 has negative feedback characteristics, an increase in the FB control line voltage decreases the output voltage of the on-voltage generating circuit 43, and a decrease in the FB control line voltage increases the output voltage of the on-voltage generating circuit 43. In the connection state of the amplifier 41*a* and the FB control line 70*a*, when the EL element current Id is low, the FB control line voltage is also low. This increases the on-voltage of the on-voltage generating circuit 43, causing withstand voltage breakdown of the gate driver IC (circuit) 12*b* and the pixel 16. In order to prevent this from happening, as FIG. 6 illustrates, constant voltage constant current (CVCC) control is performed by disposing a combining circuit 70*b* which combines the output voltage of the amplifier 41*a* of the current detecting circuit 41 and the output voltage (Von) of the on-voltage generating circuit 43 immediately prior to the FB control line 70*a*. FIG. 6 illustrates a pixel configuration of the EL display device according to the present disclosure. When the switching transistor 11*d* is an n-type switching transistor, an increase in the EL element current Id increases the voltage of the FB control line 70*a*, and a decrease in the on-voltage increases the on-resistance of the switching transistor 11*d*. This decreases the value of the current flowing through the EL element 15. When the switching transistor 11*d* is a p-type switching transistor, the switching transistor 11*d* performs operations reverse to those of the n-type transistor in the above circuit. Hence, the current of the EL element 15 becomes an overcurrent. However, making the switching element (transistor) 41*b* have a phase inversion structure solves the overcurrent.

Here, the term "phase inversion" refers to that the connection of a resistor 41*e* disposed between the positive terminal of the amplifier 41*a* and the emitter of the switching element (transistor) 41*b* is changed to a connection between the positive terminal of the amplifier 41*a* and the collector of the switching element (transistor) 41*b* (not illustrated).

The above operation allows the entire EL element current within the display screen to be controlled, achieving an object of the present disclosure, which is to reduce degradation of the EL characteristics and to provide a high display quality.

In Embodiment 1, the current Id flowing through the entire display screen 20 is detected by the current detecting circuit 41; however, the present disclosure is not limited to the example. For example, it may be that the display screen 20 is divided into a plurality of sections (for example, the display screen is divided into a plurality of sets of pixel rows), the current detecting circuit 41 is disposed for each divided section of the display screen 20, the magnitude of the flowing current or the amount of variation in the current is detected, and the on-voltage of each switching transistor 11*d* in each divided section is varied or adjusted based on the detected current.

Moreover, the present disclosure is not limited to the example where the current detecting circuit 41 is disposed for each divided section of the display screen 20. For example, it may also be that the magnitude of the flowing current or an amount of variation in the current is detected for each pixel row, and the on-voltage of each switching transistor 11*d* for each pixel row is varied or adjusted based on the detected current.

It may also be that, for example, for each pixel 16, the magnitude of the flowing current or the amount of variation in the current is detected, and the on-voltage of the switching transistor 11*d* in the pixel 16 is varied or adjusted based on the detected current.

Figure 8:
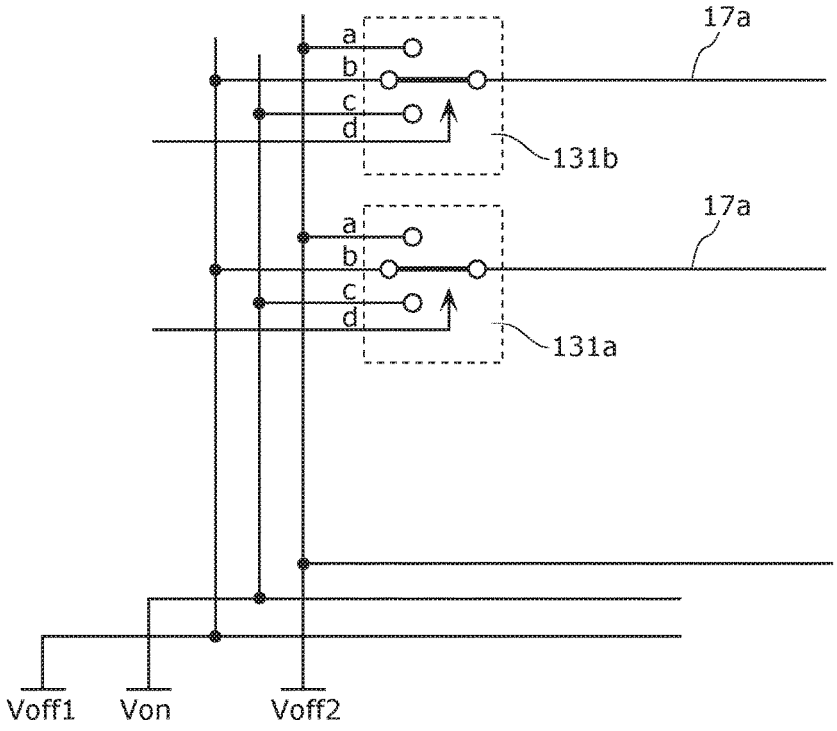
FIG. 8 illustrates a configuration of a switching circuit in the EL display device according to the present disclosure.

As illustrated in FIG. 9 to be described later, the gate driver ICs (circuits) 12*a* and 12*b* can output three voltages (Von, Voff1, and Voff2) from output terminals 123. The gate driver ICs (circuits) 12*a* and 12*b* have a mode where two voltages (Von and Voff1) are output (two-value drive of gate voltages) and a mode where three voltages (Von, Voff1, and Voff2) are output (three-value drive of gate voltages). The modes can be set by selection signal lines (SEL terminals) (see FIG. 7). FIG. 7 illustrates a configuration of a gate driver IC (circuit) and FIG. 8 illustrates a pixel configuration of the EL display device according to the present disclosure. The setting by the SEL terminals can be performed for respective scanning and output buffer circuits 121*a*, 121*b*, 121*c*, and 121*d* formed or disposed in the gate driver IC (circuit) 12*a* or 12*b*.

Figure 10:
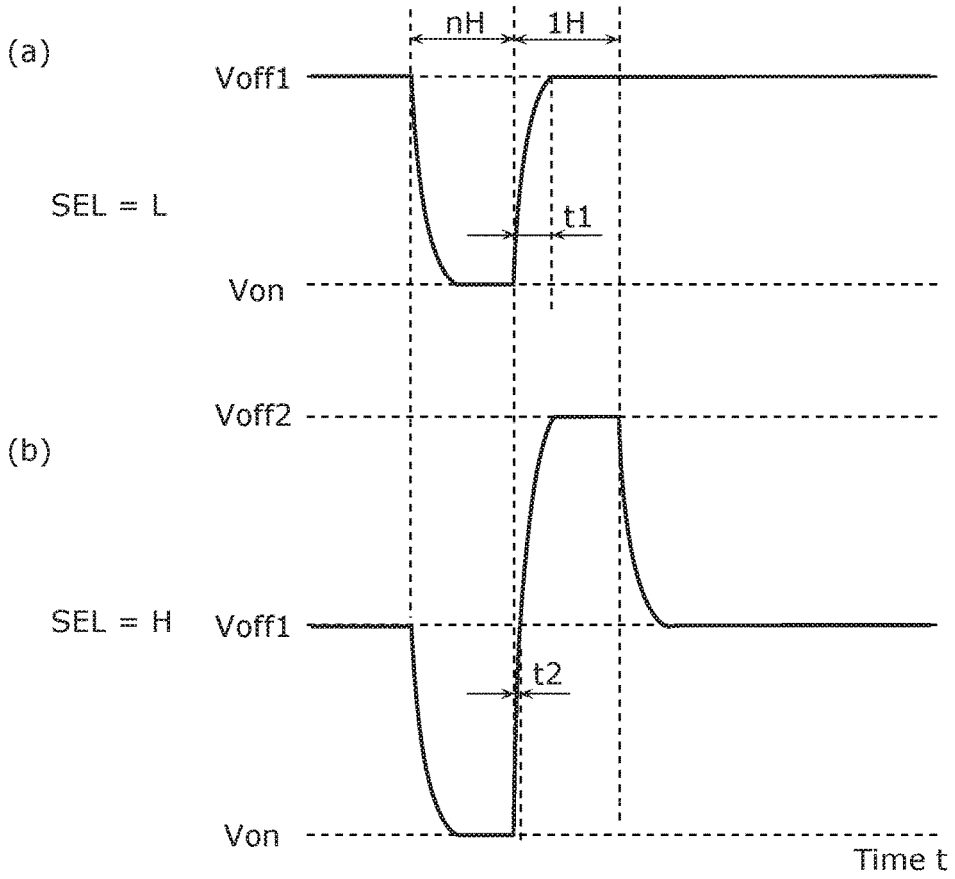
FIGS. 10(*a*) and (*b*) illustrate two-value voltage drive and three-value voltage drive in the case of a P-channel transistor.

FIG. 9 illustrates two-value voltage drive and three-value voltage drive in the case of the N-channel transistors. FIG. 10 illustrates the two-value voltage drive and three-value voltage drive in the case of the P-channel transistors.

The gate driver ICs (circuits) 12*a* and 12*b* can output the output waveforms illustrated in (b) of FIG. 9 from the output terminals 123. The output voltage includes three voltages of off-voltages (Voff1 and Voff2) and an on-voltage (Von). Since the three voltages are output, the drive is referred to as the three-value drive of gate voltages or as a gate over drive.

A driving method using two voltages of an off-voltage (Voff1) and an on-voltage (Von) is referred to as a normal drive of gate voltages or a two-value drive of gate voltages (see (a) of FIG. 9).

In the three-value drive of gate voltages, as (b) of FIG. 9 illustrates, the Von is applied to a selected gate signal line 17*a* (or 17*b*), and the voltage Voff2 is applied to the selected gate signal line 17*a* (or 17*b*) in the next pixel row selecting period. Moreover, in the pixel row selecting period after the above pixel row selecting period, the voltage Voff1 is applied. The voltage Voff2 is lower than the voltage Voff1. Accordingly, the potential difference between the voltage Von and the voltage Voff2 is greater than the potential difference between the voltage Von and the voltage Voff1. The switching transistor 11*b* of the pixel 16 is turned off upon application of the voltage Voff1.

In the two-value drive of gate voltages, time t1 is required for the voltage Von to reach Voff1. In the three-value drive of gate voltages, when the voltage Von is varied to the voltage Voff2, time t2 (t2<t1) is required for the voltage Von to reach the voltage Voff1. Accordingly, since the time taken for the voltage Von to reach the voltage Voff1 in the three-value drive of gate voltages is time t2, the switching transistor 11*b* of the pixel 16 is turned into an off state rapidly. For this reason, in the three-value drive of gate voltages, crosstalk between pixel rows does not occur.

The two-value drive of gate voltages and three-value drive of gate voltages are determined by a logic voltage applied to the SEL (SEL1 to SEL4) terminals in FIG. 7.

The on-voltage is a voltage for turning on the transistors 11 of the pixel 16. The voltages Voff1 and Voff2 are voltages for turning off the transistors 11 of the pixel 16.

The voltage Voff2 is used in order to rapidly stop selecting (turning off) pixels selected for being applied with a video signal, after writing the video signal thereto. The voltage Voff1 is used in order to reduce a variation in the transistor characteristics such as Vt shift resulting from an application of a deep voltage (Voff2) to the gate terminals of the transistors 11.

The two-value drive of gate voltages and the three-value drive of gate voltages are set by a logic voltage applied to the SEL (SEL1 and SEL 2) terminals. When the logic voltage applied to the SEL (SEL 1 to SEL 4) terminals illustrated in FIG. 7 is "L", the mode is set to the two-value drive of gate voltages. When the logic voltage applied to the SEL (SEL 1 to SEL 4) terminals is "H", the mode is set to the three-value drive of gate voltages.

The SEL (SEL1 to SEL 4) terminals are respectively connected to the scanning and output buffer circuits 121*a* to 121*d*. The outputs of the scanning and output buffer circuits 121 are set to the two-value drive of gate voltages or the three-value drive of gate voltages by the logic voltage of the SEL terminals.

In the EL display device according to Embodiment 1 illustrated in FIG. 7, the data input terminals (D1, D2, D3, and D4) and clock input terminals (Clk1*a*, Clk1*b*, Clk1*c*, and Clk1*d*) of the respective scanning and output buffer circuits 121 can be independently set.

Switching between the on-voltage, the voltage Voff1, and the voltage Voff2 is performed by switching circuits 131 as illustrated in FIG. 8. FIG. 8 illustrates a configuration of the switching circuits of the EL display device according to the present disclosure. One of terminal a (the voltage Voff2), terminal b (the voltage Voff1), and terminal c (the on-voltage) is selected by an input signal (2 bits) to terminal d of the switching circuit, and applied to the gate signal line 17.

FIG. 10 illustrates the two-value voltage drive and three-value voltage drive in the case of the P-channel transistors. As FIG. 10 illustrates, when the switching transistors 11*b*, 11*c*, and 11*d* are P-channel transistors, in the three-value drive of gate voltages and the two-value drive of gate voltages, the polarities of the on-voltage (Von) and the off-voltages (Voff1 and Voff2) are opposite to those of the on-voltage (Von) and the off-voltages (Voff1 and Voff2) illustrated in FIG. 9.

[1-3. Advantageous Effects Etc.]

As described above, the EL display device according to one aspect of the present disclosure is an active-matrix EL display device including pixels 16 arranged in rows and columns as illustrated in FIG. 2. The EL display device includes: a display screen including pixels arranged in rows and columns; a first gate signal line and a second gate signal line arranged for each pixel row; a gate driver circuit which outputs a control voltage to the first gate signal line and the second gate signal line; a current generating circuit which supplies a current to the EL elements of the display screen; a current detecting unit which obtains a magnitude of a current flowing through the pixels; and a control voltage generating circuit which generates a control voltage output to the first gate signal line by the gate driver circuit. Each of the pixels includes: a light-emitting element; a driving transistor which supplies a driving current to the light-emitting element; a first switching transistor which is disposed in a path of the driving current, and which switches between a conducting state and a non-conducting state based on the control voltage supplied from the first gate signal line; and a second switching transistor which switches between a conducting state and a non-conducting state based on the control voltage supplied from the second gate signal line, and which applies a video signal to the driving transistor. The control voltage is for turning the first switching transistor into a conducting state. The control voltage generating circuit varies the control voltage based on an output result from the current amount obtaining circuit.

When the current detected or obtained by the current detecting circuit is greater than a predetermined value, a control voltage applied to the first switching transistor is varied so as to increase the on-resistance of the first switching transistor. An increase in the on-resistance increases the voltage across the channel of the first switching transistor (voltage between the drain and source terminals), thereby decreasing a current flowing through the EL element of the pixel.

When the current detected or obtained by the current detecting circuit is less than a predetermined value, a control voltage applied to the first switching transistor is varied so as to decrease the on-resistance of the first switching transistor. A decrease in the on-resistance decreases the voltage across the channel of the first switching transistor (voltage between the drain and source terminals), thereby increasing a current flowing through the EL element of the pixel or facilitating a current flow of the EL element.

Moreover, varying the on-resistance of the first switching transistor disposed in the path of the driving current to the EL element allows the current flowing through the display screen to be controlled. Accordingly, an overcurrent flowing through the display screen can be decreased. The decrease is moderate, which prevents flicker from occurring. Moreover, the current flowing through the display screen is controlled by varying the voltage across the channel of the first switching transistor, and thus, the variations in the characteristics of the driving transistors and the EL elements of respective pixels are reduced. Accordingly, it can be reduced that variations in the characteristics of the driving transistors and the EL elements are visually seen, leading to a high-quality image display.

The current detecting circuit 41 of the EL display device described above includes a current detecting resistor which detects a panel current Id and a differential amplifier which detects a voltage across the current detecting resistor. The EL display device is of a high side type (see FIG. 5) where the current detecting circuit 41 is disposed between the voltage source Vdd and the switching transistor (control transistor) 11*d*. However, it may also be that the EL display device is of a low side type where the current detecting circuit 41 is disposed between the cathode side of the EL element and the voltage source Vss.

Figure 11:
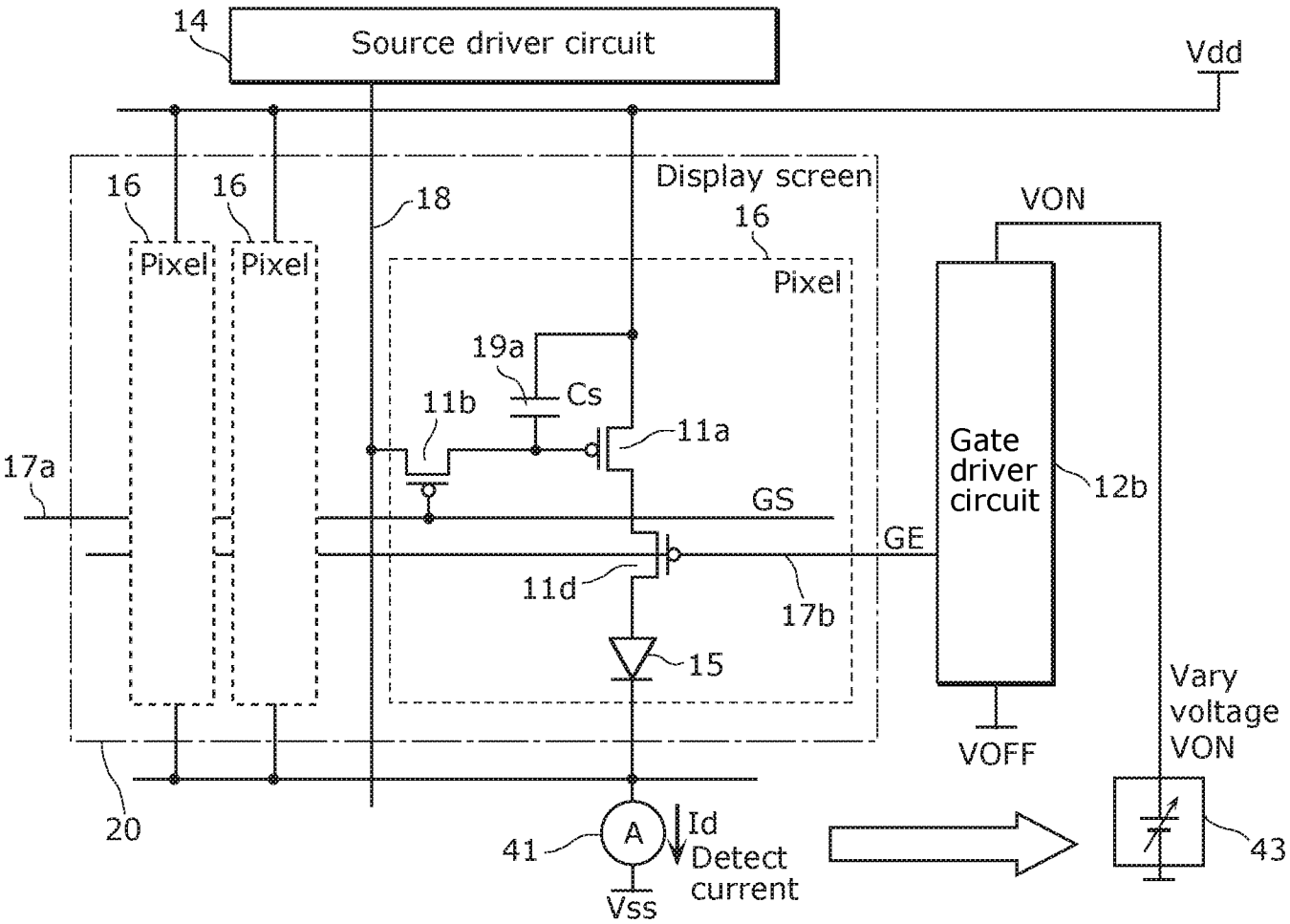
FIG. 11 illustrates the EL display device according to the present disclosure.

FIG. 11 illustrates a configuration of an EL display device including the current detecting circuit 41 which detects a cathode current.

As FIG. 11 illustrates, the current detecting circuit (unit) 41 detects the current Id flowing through the display screen 20 connected to the cathode side of the EL element 15, and varies the on-voltage generated by the on-voltage generating circuit 43, based on the magnitude of the detected current or the variation rate of the current. The current flowing through the display screen 20 is varied by varying the on-voltage. Detailed operations of the current detecting circuit 41 are similar to those of the current detecting circuit 41 illustrated in FIG. 4.

The other configurations of the EL display device illustrated in FIG. 11 are similar to those to be described in subsequent embodiments, and thus, the descriptions thereof are omitted here.

Figure 12:
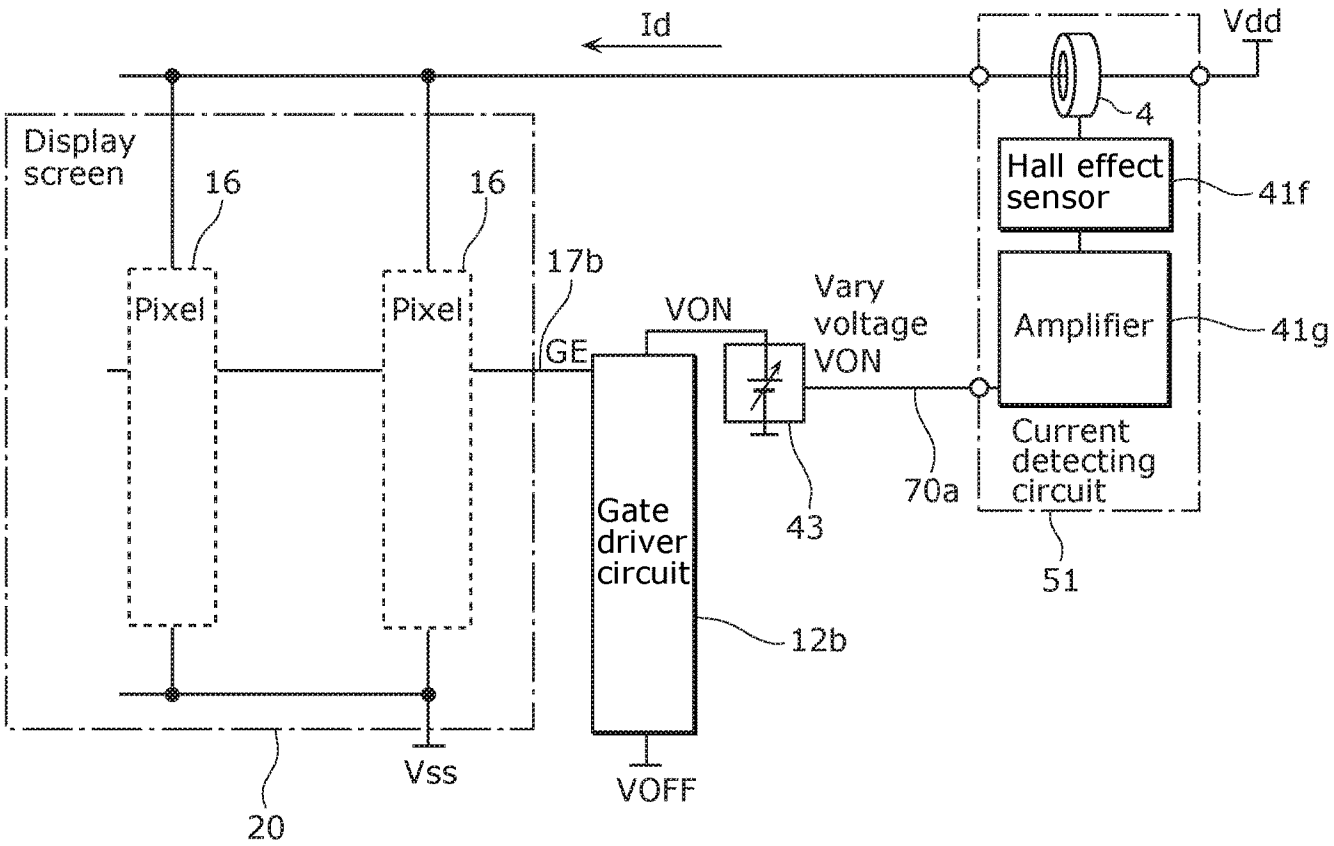
FIG. 12 illustrates a pixel configuration in the EL display device according to the present disclosure.

The current detecting circuit of the EL display device described above is not limited to a resistor. For example, as FIG. 12 illustrates, the current detecting circuit may be a current detecting circuit 51 including a current transformer 4, a hall effect sensor 41*f*, and an amplifier 41*g*. In this case, only the method of detecting a current performed by the current detecting circuit 51 is different from that performed by the current detecting circuit 41. The difference in the current measuring positions (high side type/low side type) does not affect the control. Of course, the current detecting circuit 51 can also decrease the EL element current in a similar manner to the current detecting circuit 41. In this configuration, a pick up resistor and the like need not be disposed along the anode line and the cathode line, which facilitates the configuration.

Variation 1 of Embodiment 1

Hereinafter, Variation 1 of Embodiment 1 will be described with reference to FIG. 13 to FIG. 15.

FIG. 2 illustrates the embodiment where one pixel includes three transistors. In FIG. 2, two gate signal lines 17 are connected to one pixel. However, the present disclosure is not limited to such an example, and the present disclosure is also applicable to another pixel configuration as illustrated in FIG. 13.

Figure 13:
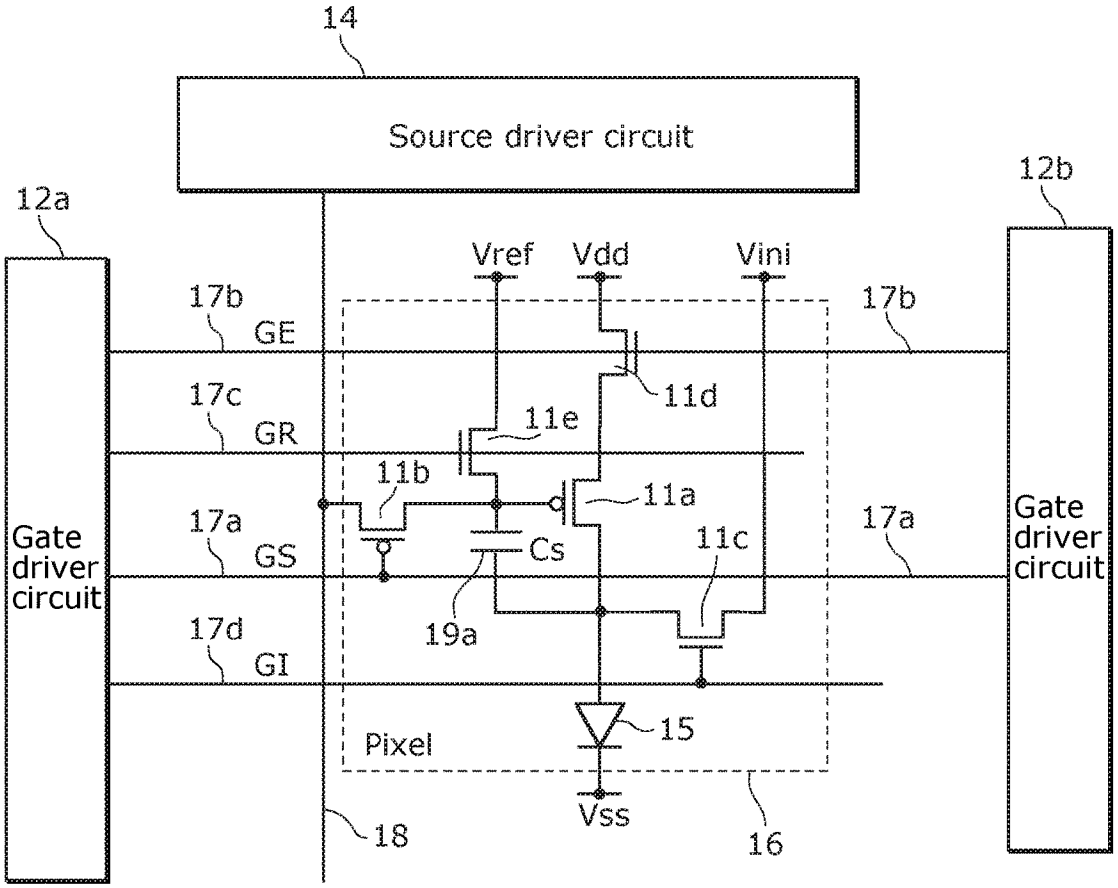
FIG. 13 illustrates a pixel configuration in the EL display device according to the present disclosure.

In FIG. 13, a switching transistor 11*e* includes a gate terminal connected to a gate signal line 17*c*, and one of the source and the drain connected to Vref. A switching transistor 11*c* has a function of determining the timing at which the Vini is applied to an electrode of a capacitor 19*a*. The switching transistor 11*e* and the switching transistor 11*c* are, for example, n-type thin-film transistors (n-type TFTs).

The driving transistor 11*a* is a driving element having a drain connected to the anode voltage Vdd which is a first power supply line, and a source connected to the anode of the EL element 15. The driving transistor 11*a* converts the voltage corresponding to the signal voltage applied between the gate and the source into a drain current corresponding to the signal voltage. The drain current is supplied to the EL element 15 as a signal current. The driving transistor 11*a* is, for example, an n-type thin-film transistor (n-type TFT).

The EL element 15 is a light-emitting element having a cathode connected to a cathode voltage Vss which is a second power supply line. The EL element 15 emits light in response to the signal current supplied by the driving transistor 11*a*.

The switching transistor 11*d* is a switching transistor having a gate connected to the gate signal line 17*b*, and one of the source and drain terminals connected to the drain terminal of the driving transistor 11*a*. The switching transistor 11*d* is, for example, an n-type thin-film transistor (n-type TFT).

The capacitor 19*a* first stores the source potential of the driving transistor 11*a* (potential of the source signal line 18) in a steady state when the switching transistor 11*b* is in a conducting state. After that, the potential of the capacitor 19*a* is determined even when the switching transistor 11*b* is brought into an OFF state, and thus a gate voltage of the driving transistor 11*a* is determined.

The capacitor 19*a* is formed or disposed so as to overlap (stack) with the source signal line 18 and the gate signal lines 17 (at least one of 17*a*, 17*b*, 17*c*, and 17*d*). In this case, layout flexibility is improved, a wider space can be secured between elements, and yield is improved.

The EL display device includes source signal lines 18 for respective pixel columns. The gate signal lines 17*a* and 17*b* are connected to both the gate driver ICs (circuits) 12*a* and 12*b*, and connected to each EL element 15 in a pixel row including the pixel 16. With this, the gate signal lines 17*a* and 17*b* have a function of supplying timing at which the signal voltage is written into each EL element 15 in the pixel row including the pixels 16, and a function of supplying timing at which a reference voltage is applied to the gate of the driving transistor 11*a* of the pixel 16.

In Variation 1 of Embodiment 1 illustrated in FIG. 13, it is preferable that the relation of the anode voltage Vdd> the reference voltage Vref> the cathode voltage Vss> an initial voltage Vini is satisfied. Specifically, as an example, the anode voltage Vdd ranges from 10 to 18 (V), the reference voltage Vref ranges from 1.5 to 3 (V), the cathode voltage Vss ranges from 0.5 to 2.5 (V), and the initial voltage Vini ranges from 0 to −3 (V).

It may be that the switching transistor 11*d* is disposed or formed between the source terminal of the driving transistor 11*a* and the anode terminal of the EL element 15.

The gate terminal of the switching transistor 11*d* is connected to the gate signal line 17*b*. The gate terminal of the switching transistor 11*e* is connected to the gate signal line 17*c*. The gate terminal of the switching transistor 11*b* is connected to the gate signal line 17*a*. The gate terminal of the switching transistor 11*c* is connected to the gate signal line 17*d*.

In the embodiment illustrated in FIG. 13, it may be that the gate signal line 17*b* connected to the gate terminal of the switching transistor 11*d* is referred to as a gate signal line GE, the gate signal line 17*c* connected to the gate terminal of the switching transistor 11*e* is referred to as a gate signal line GR, the gate signal line 17*a* connected to the gate terminal of the switching transistor 11*b* is referred to as a gate signal line GS, and the gate signal line 17*d* connected to the gate terminal of the switching transistor 11*c* is referred to as a gate signal line GI.

When an on-voltage is applied to the gate signal line 17*b* (GE), the switch transistor 11*d* is turned on, and a light emission current is supplied from the driving transistor 11*a* to the EL element 15. The EL element 15 emits light based on the magnitude of the light emission current. The magnitude of the light emission current is determined by causing the switching transistor 11*b* to apply, to the pixel 16, the video signal applied to the source signal line 18.

The capacitor 19*a* has one terminal connected to the gate terminal of the driving transistor 11*a*, and the other terminal connected to the source terminal of the driving transistor 11*a*. The drain terminal of the switching transistor 11*b* is connected to the source signal line 18. The source driver IC (circuit) 14 applies a video signal to the source signal line 18.

Figure 14:
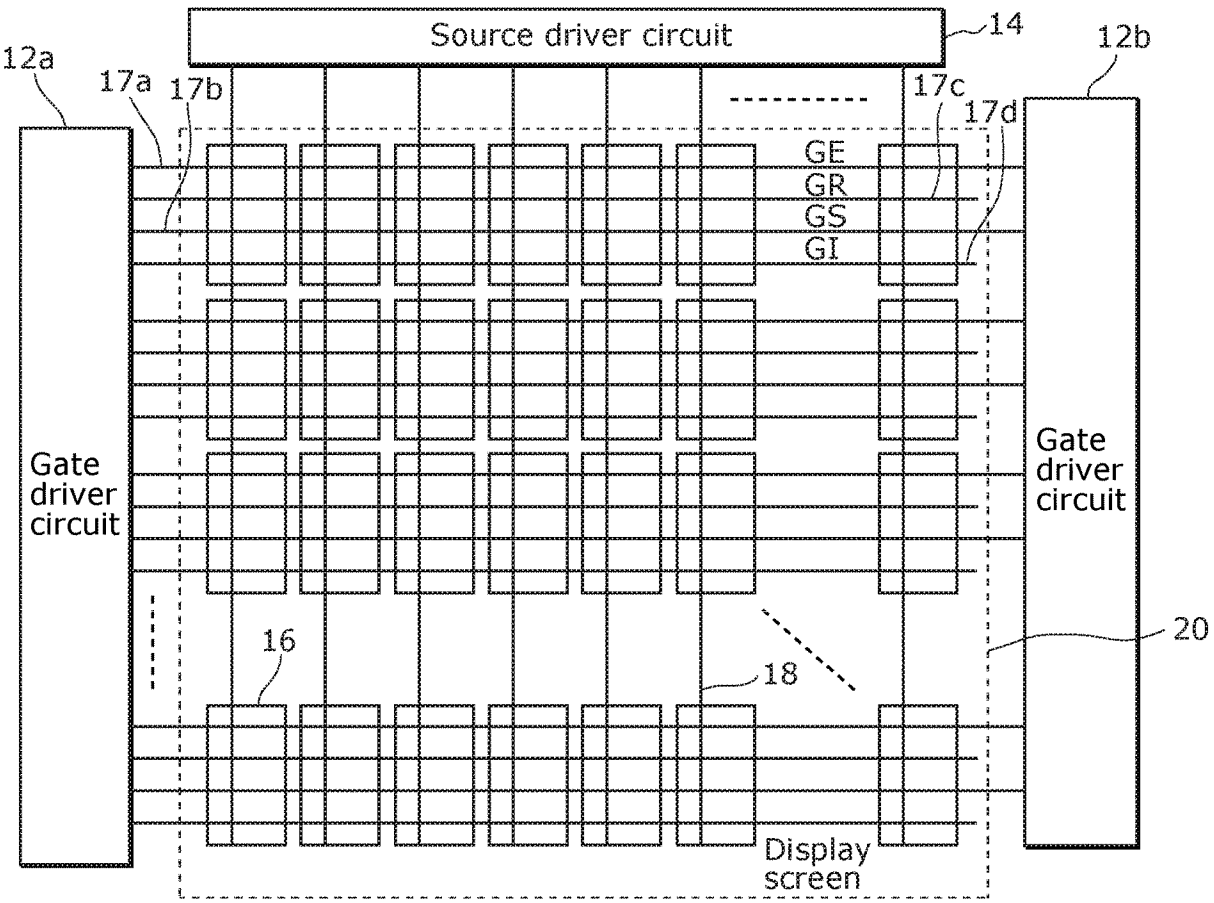
FIG. 14 illustrates a configuration of the EL display device according to the present disclosure.

FIG. 14 illustrates a pixel configuration of the EL display device according to the present disclosure. As FIG. 14 illustrates, the gate signal lines 17*a* and 17*b* are connected to the gate driver ICs (circuits) 12*a* and 12*b* disposed on the left and right sides of the display screen 20. The gate signal lines 17*c* and 17*d* are connected to the gate driver IC (circuit) 12*a* disposed on the left side of the display screen 20 (see FIG. 14).

The gate driver IC (circuit) 12*a* applies a pixel selection voltage (on-voltage Von) to the gate signal lines 17*a*, 17*b*, 17*c*, and 17*d*. The gate driver IC (circuit) 12*b* applies a pixel selection voltage (on-voltage Von) to the gate signal lines 17*a* and 17*b*. When the on-voltage is applied to the gate signal line 17*b*, the switching transistor 11*b* is turned on, and the video signal applied to the source signal line 18 is applied to the pixel 16.

The EL display panel includes the display screen 20 including the pixels 16 arranged in rows and columns. Each of the pixels 16 includes the EL element 15.

As FIG. 13 illustrates, both ends of the gate signal lines 17*a* and 17*b* are connected to the gate driver ICs (circuits) 12*a* and 12*b*. One end of each of the gate signal lines 17*c* and 17*d* is connected to the gate driver IC (circuit) 12*a*. The gate driver ICs (circuits) 12*a* and 12*b* each are mounted on a chip on film (COF) (not illustrated).

Likewise, each pixel 16 is connected to the source signal line 18. The source signal line 18 has one end connected to the source driver IC (circuit) 14. The source driver IC (circuit) 14 is mounted on a COF (not illustrated).

The source driver IC (circuit) 14 outputs a video signal which is supplied or applied to the source signal line 18.

Figure 15:
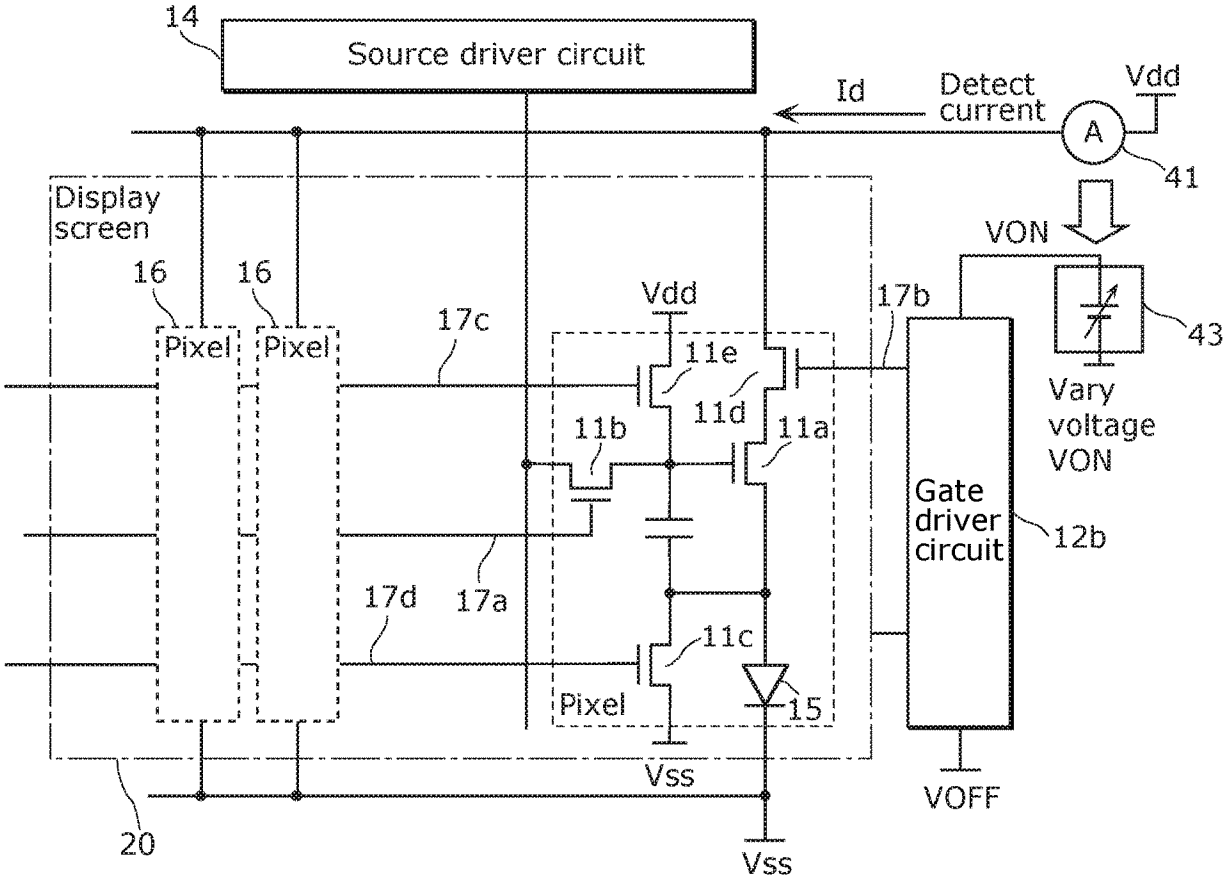
FIG. 15 illustrates a pixel configuration in the EL display device according to the present disclosure.

FIG. 15 illustrates an EL display device according to the present embodiment which corresponds to the pixel configuration in FIG. 13.

The on-voltage (Von) is supplied to the gate driver IC (circuit) 12*b*, and the on-voltage is output to the gate signal line 17*b* (gate signal line GE).

In FIG. 13 to FIG. 15, the switching transistor 11*d* is an N-channel transistor. Accordingly, an on-voltage is a positive voltage. An off-voltage is a negative voltage.

With an increase in the on-voltage, the voltage Vd across the channel of the switching transistor 11*d* decreases. This facilitates the flow of a current to the EL element 15.

With a decrease in the on-voltage, the voltage Vd across the channel of the switching transistor 11*d* decreases. Accordingly, the voltage Ve is unlikely to be applied to the EL element 15, which makes a current to be unlikely to flow into the EL element 15 (the current flow into the EL element is decreased).

As described above, the voltage Vd across the channel of the switching transistor 11*d* can be varied by varying the on-voltage.

Varying the on-voltage of the gate signal line 17*b* varies the voltage Vd across the channel of the switching transistor 11*d*. Since the cathode voltage Vss and the anode voltage Vdd each are a constant voltage, a variation in the Vd varies the voltage Va across the channel of the driving transistor 11*a* and the voltage Ve across the terminals of the EL element 15. Accordingly, the current flowing through the EL element 15 can be varied by varying the voltage Vd. A variation in the current of the EL element 15 leads to a variation in the current flowing through the display screen 20. Accordingly, the current flowing through the display screen 20 can be varied by varying the on-voltage.

In the present disclosure, the voltage Vd across the channel of the switching transistor 11*d* can be varied by varying the on-voltage. The variation in Vd is divided appropriately into the voltage Va across the channel of the driving transistor 11*a* and the voltage Ve across the terminals of the EL element 15. The voltage division is carried out according to the characteristics of the driving transistor 11*a* and the EL element 15. The characteristics of the driving transistors 11*a* and the EL elements 15 vary within the display screen 20. Accordingly, unlike the case where the anode voltage Vdd is decreased (varied), occurrence of stripe unevenness is reduced and no flicker is caused.

In the present disclosure, the current detecting circuit 41 detects, for example, when the current flowing through the display screen 20 increases or when the current flowing through the display screen 20 exceeds a predetermined value, and the on-voltage generating circuit 43 is controlled based on the detected or measured current or the data proportional to the current. The on-voltage generating circuit 43 varies the on-voltage so as to increase the voltage Vd across the channel of the switching transistor 11*d*. As a result, the current flowing through the EL element 15 is decreased.

In the present disclosure, the current detecting circuit 41 detects, for example, when the current flowing through the display screen 20 decreases or when the current flowing through the display screen 20 becomes below a predetermined value, and the on-voltage generating circuit 43 is controlled based on the detected or measured current or the data proportional to the current. The on-voltage generating circuit 43 varies the on-voltage so as to decrease the voltage Vd across the channel of the switching transistor 11*d*. As a result, control is performed such that the current flowing through the EL element 15 increases, and light emission is provided with higher peak luminance.

Variation 2 of Embodiment 1

Hereinafter, Variation 2 of Embodiment 1 will be described with reference to FIG. 16.

Figure 16:
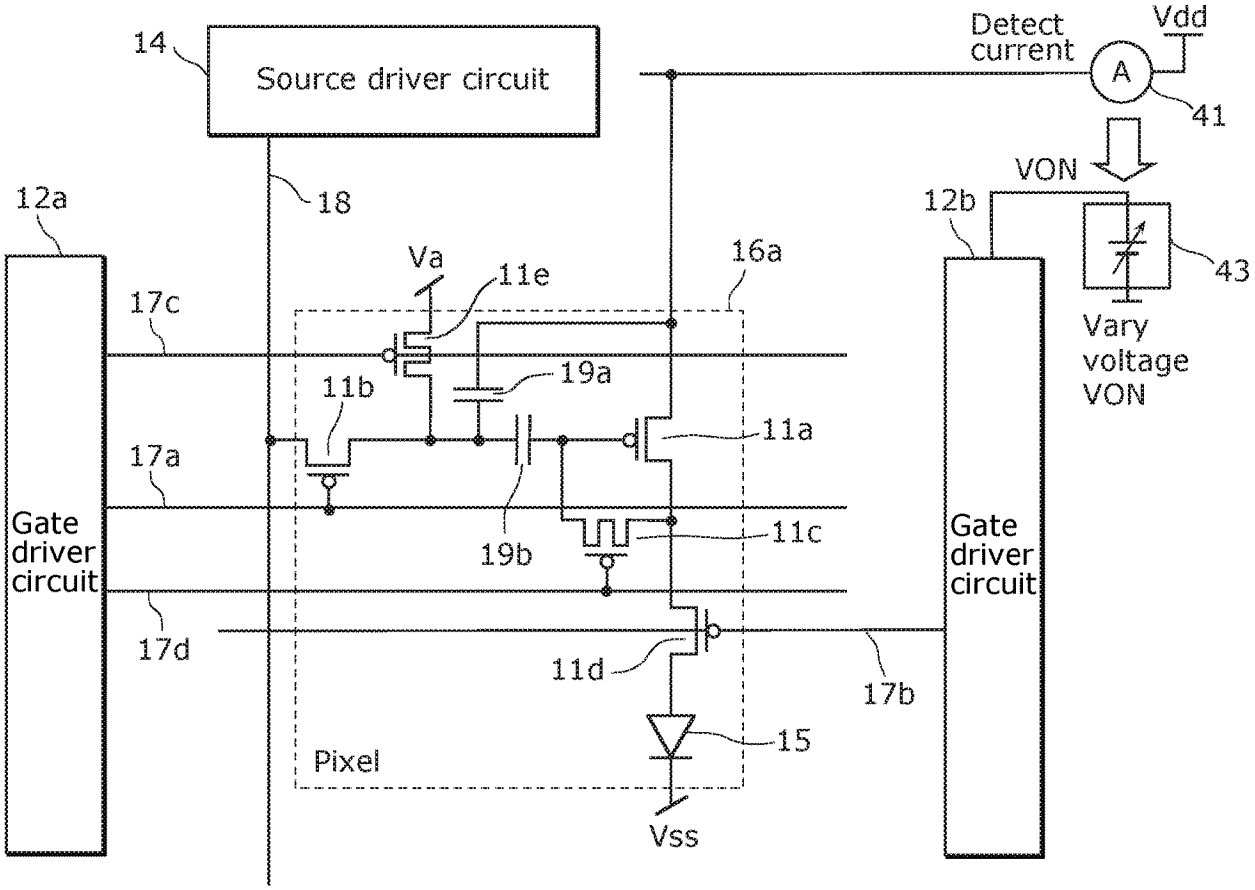
FIG. 16 illustrates a pixel configuration in the EL display device according to the present disclosure.

FIG. 16 illustrates an embodiment corresponding to another pixel configuration. In the embodiment illustrated in FIG. 16, in a similar manner to FIG. 2, the switching transistor 11*d* is a P-channel transistor. Accordingly, an on-voltage is a negative voltage. An off-voltage is a positive voltage.

FIG. 16 illustrates a pixel configuration of the EL display device according to the present disclosure. The gate signal line 17*c* is connected to the gate terminal of the switching transistor 11*e* to control on and off of the switching transistor 11*e*. The gate signal line 17*a* is connected to the gate terminal of the switching transistor 11*b* to control on and off of the switching transistor 11*b*. The gate signal line 17*d* is connected to the gate terminal of the switching transistor 11*c* to control on and off of the switching transistor 11*c*. The gate signal line 17*b* is connected to the gate terminal of the switching transistor 11*d* to control on and off of the switching transistor 11*d*.

In the pixel configuration illustrated in FIG. 16, the gate signal lines 17*a*, 17*c*, and 17*d* are connected to the gate driver IC (circuit) 12*a*, and the gate signal line 17*b* is connected to the gate driver IC (circuit) 12*b*.

In FIG. 16, the drain terminal of the P-channel driving transistor 11*a* is connected to the source terminal of the switching transistor 11*d*, and the drain terminal of the switching transistor 11*d* is connected to the anode terminal of the EL element 15. The cathode voltage Vss is applied to the cathode terminal of the EL element 15. The anode voltage Vdd is applied to the source terminal of the driving transistor 11*a*.

When an on-voltage is applied to the gate signal line 17*b*, the switching transistor 11*d* is turned on, and a light emission current is supplied from the driving transistor 11*a* to the EL element 15. The EL element 15 emits light based on the magnitude of the light emission current.

The source terminal and the drain terminal of the switching transistor 11*c* are connected between the gate terminal and the drain terminal of the driving transistor 11*a*. When an on-voltage is applied to the gate signal line 17*d*, the gate terminal and the drain terminal of the driving transistor 11*a* are short-circuited (connected).

The gate terminal of the driving transistor 11*a* is connected to one terminal of the capacitor 19*b*. The other terminal of the capacitor 19*b* is connected to the drain terminal of the switching transistor 11*b*. The source terminal of the switching transistor 11*b* is connected to the source signal line 18.

When the on-voltage is applied to the gate signal line 17*a*, the switching transistor 11*b* is turned on, and the video signal (voltage, current) applied to the source signal line 18 is applied to the pixel 16. In the present disclosure, the video signal is a video signal voltage, but may be a video signal current.

The capacitor 19*a* has one terminal connected to the drain terminal of the switching transistor 11*b*, and the other terminal which is connected to the anode electrode (terminal) and to which the anode voltage Vdd is applied.

It has been described above that the other terminal of the capacitor 19*a* is connected to the anode electrode (terminal), and the anode voltage Vdd is applied to the other terminal, but the present disclosure is not limited to the example. For example, the other terminal of the capacitor 19*a* may be connected to any other given DC voltage.

It has been described above that the source terminal of the driving transistor 11*a* is connected to the anode electrode (terminal) and the anode voltage Vdd is applied to the source terminal, but the present disclosure is not limited to the example. For example, the source terminal of the driving transistor 11*a* may be connected to any other given DC voltage. In other words, it may be that one terminal of the capacitor 19*a* and the source terminal of the driving transistor 11*a* are connected to terminals having different potentials.

For example, the source terminal of the driving transistor 11*a* is connected to an electrode or a line applied with the anode voltage Vdd, and one terminal of the driving transistor 11*a* is connected to an electrode or a line applied with DC voltage of Vb=5 (V).

The drain terminal of the switching transistor 11*e* is connected to the drain terminal of the switching transistor 11*b*, and the source terminal of the switching transistor 11*e* is connected to an electrode or a signal line applied with a reset voltage Va. When an on-voltage is applied to the gate signal line 17*c*, the switching transistor 11*e* is turned on, and the reset voltage Va is applied to the capacitor 19*a*.

The switching transistor 11*c* and the switching transistor 11*e* are P-channel transistors, and have an LDD structure. The switching transistors 11*c* and 11*e* each have at least double gates (dual gates). Preferably, the switching transistors 11*c* and 11*e* have triple or more gates. In other words, a configuration is employed in which the gates of a plurality of transistors are connected in series.

Employing the LDD structure and multi-gate structure (dual-gate, triple-gate, or more gates) can enhance excellent off-characteristics of the switching transistors 11*c* and 11*e*. Without enhanced off-characteristics of the switching transistors 11*c* and 11*e*, the charges of the capacitor 19*a* cannot be held properly.

It is preferable that the transistors other than the switching transistors 11*c* and 11P are also P-channel transistors, and have an LDD structure. As necessary, the transistors may have a multigate structure.

By using the multigate transistors (more than dual gates) or combining with the LDD structure, off-leakage can be reduced, and excellent contrast and offset cancellation can be realized. In addition, an excellent high luminance display and image display can be realized.

The switching transistor 11*b* applies, to the gate terminal of the driving transistor 11*a* of the pixel 16, the video signal output from the source driver IC (circuit) 14. The driving transistor 11*a* performs voltage-to-current conversion based on the applied video signal, and supplies a light emission current to the EL element 15 based on the video signal.

Decreasing the on-voltage applied to the gate terminal of the switching transistor 11*d* causes the switching transistor 11*d* to be in an on state at a high level and to operate in a saturated region. The voltage across the channel (between the source and the drain) of the switching transistor 11*d* decreases. Accordingly, a sufficient voltage is applied to the EL element 15 and across the channel of the driving transistor 11*a*. Hence, a constant current from the driving transistor 11*a* is supplied to the EL element 15.

An increase in the on-voltage applied to the gate terminal of the switching transistor 11*d* increases the on-resistance across the channel of the switching transistor 11*d* (causes the switching transistor 11*d* to operate in a linear region). An increase in the on-resistance across the channel (between the source and the drain) of the switching transistor 11*d* increases the voltage across the channel of the switching transistor 11*d*. Accordingly, a voltage is unlikely to be applied across the channel of the driving transistor 11*a* and to the EL element 15. Hence, a current supplied to the EL element 15 by the driving transistor 11*a* is decreased.

As described above, according to the present disclosure, when the current supplied to the EL element 15 is to be decreased, the on-voltage applied to the gate terminal of the switching transistor 11*d* is increased, and the resistance across the channel of the switching transistor 11*d* is increased.

Varying the on-voltage of the gate signal line 17*b* varies the voltage Vd across the channel of the switching transistor 11*d*. Since the cathode voltage Vss and the anode voltage Vdd each are a constant voltage, a variation in the Vd varies the voltage Va across the channel of the driving transistor 11*a* and the voltage Ve across the terminals of the EL element 15.

Accordingly, a current flowing through the EL element 15 can be varied by varying the voltage Vd across the channel of the switching transistor 11*d*. A variation in the current of the EL element 15 leads to a variation in the current flowing through the display screen 20. Accordingly, the current flowing through the display screen 20 can be varied by varying the on-voltage.

As described above, the switching transistor 11*d* illustrated in FIG. 16 is a P-channel transistor. Hence, in the three-voltage drive of gate voltages and the two-value drive of gate voltages, as illustrated in FIG. 10, the polarities of the on-voltage (Von) and the off-voltages (Voff1 and Voff2) are opposite to those in FIG. 9.

In the above described embodiment, the current detecting circuit 41 detects when the current flowing through the display screen 20 increases or when the current flowing through the display screen 20 exceeds a predetermined value, and the on-voltage generating circuit 43 is controlled based on the detected or measured current or the data proportional to the current.

Embodiment 2

Hereinafter, Embodiment 2 will be described with reference to FIG. 17.

Figure 17:
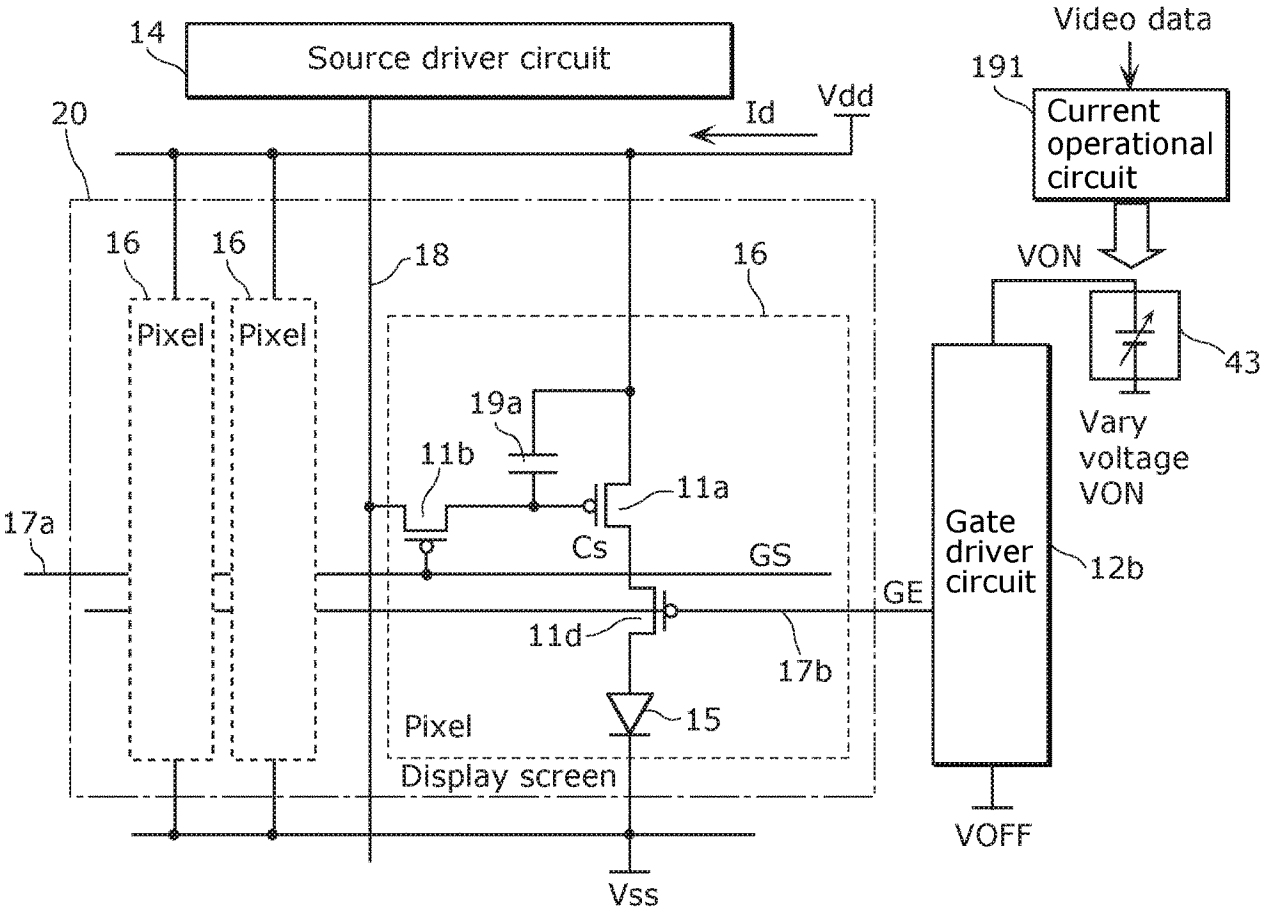
FIG. 17 illustrates a pixel configuration in the EL display device according to the present disclosure.

FIG. 17 illustrates an embodiment where a current operational circuit 191 performs processing (an operation) on an input video signal to obtain the current Id flowing through the display screen 20 or data proportional to the current and control the on-voltage generating circuit 43 based on such data. The current operational circuit 191 corresponds to a current amount obtaining circuit according to the present disclosure.

The current flowing through the EL element 15 of the pixel 16 and luminance of the EL element 15 are in a linear (proportional) relation. Hence, power consumption of the panel can be obtained by calculating, for example, the sum of video data.

As described above, data based on the current flowing through the display screen 20 can be obtained by obtaining the sum of the video data and, for example, integrating the sum.

The EL elements 15 have different light emission efficiency depending on red (R), green (G), and blue (B). In general, B has a lowest light emission efficiency. G has a second lowest light emission efficiency. R has a highest light emission efficiency. In view of this, a multiplier (not illustrated) is used to weight the light emission efficiency. A multiplier for the R (not illustrated) performs multiplication on the light emission efficiency of the R with respect to R image data (Rdata). A multiplier for the G (not illustrated) performs multiplication on the light emission efficiency of the G with respect to G image data (Gdata). A multiplier for the B (not illustrated) performs multiplication on the light emission efficiency of the B with respect to B image data (Bdata).

R, G, and B have different luminosity factors. The luminosity factor according to the national television system committee (NTSC) is R:G:B=3:6:1. Accordingly, the R multiplier (not illustrated) multiplies the light emission efficiency by three with respect to the Rdata. The G multiplier (not illustrated) multiplies the light emission efficiency by six with respect to the Gdata. The B multiplier (not illustrated) multiplies the light emission efficiency by one with respect to the Bdata.

The above-described input data is RGB data (red is RDATA, green is GDATA, and blue is BDATA), but the present disclosure is not limited to the example. The input data may be YUV (luminance data and chromaticity data). In the case of the YUV, Y (luminance) data, or Y data and UV (chromaticity) data are directly weighted, or light emission efficiency is converted into, for example, luminance data in view of the light emission efficiency relative to the chromaticity before being weighted. The other matters have been illustrated with reference to FIG. 2 and the like, and thus, the descriptions thereof are omitted.

As described above, in the present disclosure, the current detecting circuit may be used to measure or detect a current. Moreover, the current operational circuit may be used to obtain, for example, a value based on a current and the like. Alternatively, both the current detecting circuit and the current operational circuit may be used to obtain a current and the like. In the embodiments of the present disclosure, a current is obtained; however, the present disclosure is not limited to such an example, but a value proportional to a current may be obtained. A value based on a current or a value related to the current may also be obtained. The current value includes a variation in current or a variation rate of the current. Accordingly, a current amount obtaining circuit may be used.

Other Embodiments

It is possible to apply the details (or part of the details) described with reference to the drawings in each of the above-described embodiments, to various electronic devices. To be specific, it is possible to apply them to the display screens of electronic devices.

Examples of such electronic devices include: a video camera, a digital camera, a head mounted display, a navigation system, an audio reproducing device (a car audio, an audio component, etc.), a computer, a gaming device, a mobile information terminal (a mobile computer, a mobile phone, a mobile game device, a digital book, etc.), an image reproducing apparatus including a recording medium (to be specific, a device including a display capable of reproducing a recording medium of a digital versatile disc (DVD) or the like and displaying the image thereof), etc.

Figure 18:
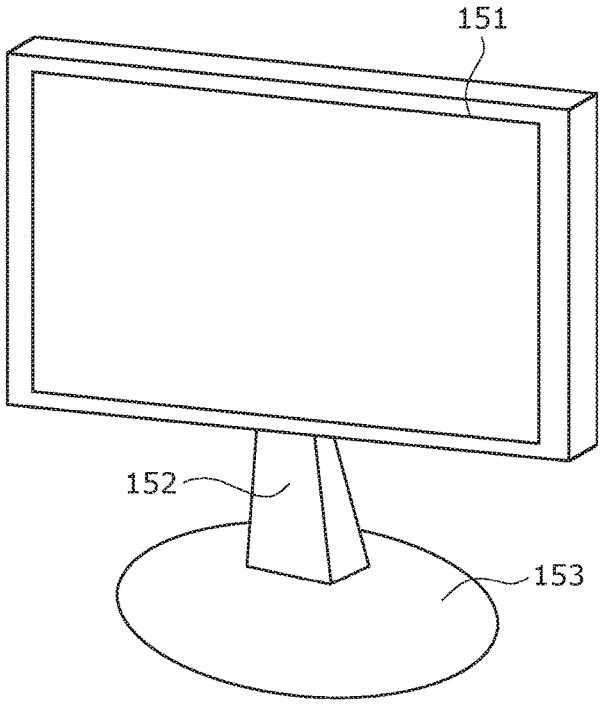
FIG. 18 illustrates a display which employs the EL display device according to the present disclosure.

FIG. 18 illustrates a display including a support column 152, a holding base 153, and the EL display device (EL display panel) 151 according to the present invention. The display illustrated in FIG. 18 has a function of displaying various information items (a still image, video, a text image, etc.) on a display portion. It is to be noted that the function of the display illustrated in FIG. 18 is not limited to this, and the display can have various functions.

Figure 19:
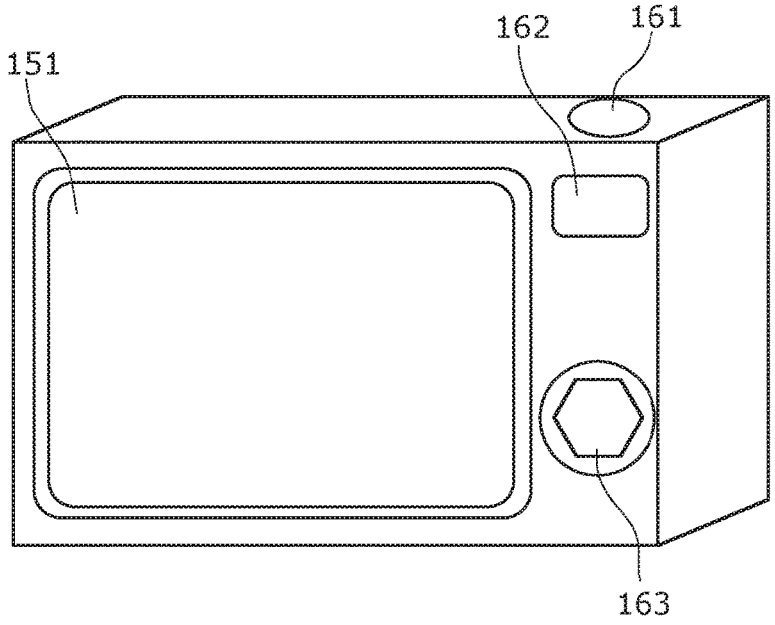
FIG. 19 illustrates a digital camera which employs the EL display device according to the present disclosure.

FIG. 19 illustrates a camera including a shutter 161, a viewfinder 162, a cursor 163, and the EL display device (EL display panel) 151 according to the present invention. The camera illustrated in FIG. 19 has a function of capturing a still image. The camera also has a function of capturing video. It is to be noted that the functions of the camera illustrated in FIG. 19 are not limited to these functions, and the camera can have various functions.

Figure 20:
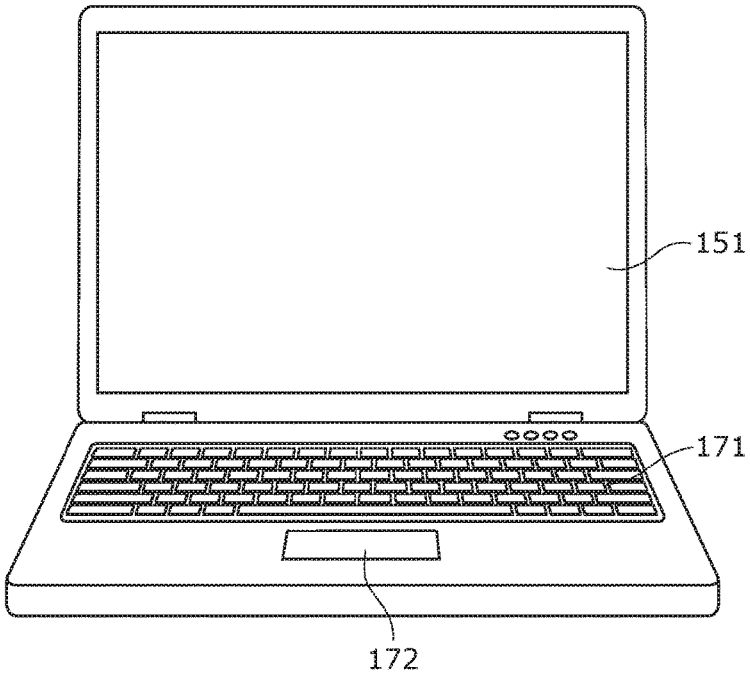
FIG. 20 illustrates a laptop personal computer which employs the EL display device according to the present disclosure.

FIG. 20 illustrates a computer including a keyboard 171, a touch-pad 172, and the EL display device (EL display panel) 151 according to the present invention. The computer illustrated in FIG. 20 has a function of displaying various information items (a still image, video, a text image, etc.) on a display portion. It is to be noted that the function of the computer illustrated in FIG. 20 is not limited to this, and the computer can have various functions.

It should be understood that the above-described embodiment can also be applied to the other embodiments according to the present disclosure. It should also be understood that it is possible to combine the present embodiment with other embodiments.

It is possible to improve the image quality of the above-described information apparatuses illustrated in FIG. 18 to FIG. 20 and reduce cost, by employing the EL display device (EL display panel) or the driving system described in the above-described embodiments in the configuration of the display portions in the present embodiment. In addition, it is possible to easily perform test or adjustment.

It is possible to arbitrarily combine the present embodiment with other embodiments.

In the present disclosure, the drawings include omitted, magnified or reduced portions to facilitate understanding or creation of the drawings.

The matters and content illustrated in the drawings or described in this embodiment of the Description according to the present disclosure are also applicable to other embodiments. The EL display panel illustrated in the drawings or described in this embodiment disclosed herein is applicable to EL display devices according to the present disclosure.

For example, needless to say, as the EL display device 151 of a laptop personal computer in FIG. 20, one of the EL display devices (EL display panels) illustrated in the drawings or described in the embodiments of the present disclosure can be employed to form an information apparatus.

Parts assigned with the same numbers or symbols have identical or similar forms, materials, functions, relevant matters, perform identical or similar actions, or provide identical or similar effects.

The details illustrated in the drawings etc. can be combined with other embodiments etc. even when no such indication is provided. For example, it is possible to form an information display device and the like as illustrated in FIG. 18, FIG. 19, and FIG. 20 by adding a touch panel etc. on the EL display panel as illustrated in FIG. 2 according to the present disclosure.

The EL display device according to the present disclosure may conceptually include system apparatuses such as information apparatuses. The EL display panels may conceptually include the system apparatuses such as information apparatuses in a broad sense.

Although the driving transistor 11*a* and the switching transistors 11*b* and 11*d* are described as thin-film transistors in the present disclosure, the driving transistor and the switching transistors according to the present disclosure are not limited to the thin-film transistors. Thin-film diodes (TFDs), ring diodes, and the like may also be used to form the same.

The driving transistors and the switching transistors are not limited to such thin-film elements, but also may be transistors formed on a silicon wafer. For example, a transistor may be firstly formed using a silicon wafer, and removed and transferred onto a glass board. Moreover, for example, a display panel on which a transistor chip formed using a silicon wafer is mounted by bonding on a glass substrate is exemplified.

The transistors 11 (the driving transistor 11*a* and the switching transistors 11*b* and 11*d*) may be, of course, FETs, MOS-FETs, MOS transistors, or bipolar transistors. Those transistors are also basically thin-film transistors. Additionally, the transistors may be, of course, varistors, thyristors, ring diodes, photodiodes, photo transistors, PLZT elements, etc.

It is preferable that the transistor 11 (the driving transistor 11*a* and switching transistors 11*b* and 11*d*) according to the present disclosure has an LDD structure regardless of whether the transistor 11 is an N-channel transistor or a P-channel transistor.

Furthermore, the transistor 11 may be any one of those formed using: HTPS; LTPS; CGS; TAOS, IZO; AS; and RTA.

In FIG. 2 and FIG. 16, the transistors (the driving transistor 11*a* and the switching transistors 11*b* and 11*d*) included in the pixel are all P-channel transistors. However, the transistors 11 of the pixel according to the present disclosure are not limited to the P-channel transistors. The transistors 11 may include only N-channel transistors or each include both the N-channel and P-channel transistors. Moreover, the driving transistor 11*a* may include both the P-channel and N-channel transistors.

The switching transistors 11*b* and 11*d* are not limited to transistors, but may be, for example, analog switches each including both the P-channel and N-channel transistors.

It is preferable that the transistors 11 (the driving transistor 11*a* and the switching transistors 11*b* and 11*d*) each have a top gate structure. This is because the top gate structure decreases parasitic and a gate electrode pattern of the top gate functions as a light shielding layer to shield light emitted from the EL element 15, making it possible to reduce malfunction of the transistor or an off-leakage current.

It is preferable, in the process to be carried out, that a copper line or a copper alloy line can be employed as a line material for the gate signal line 17 or the source signal line 18, or for both the gate signal line 17 and the source signal line 18. This is because it is possible to decrease wiring resistance of the signal lines and a larger EL display panel can be implemented.

It is preferable that the gate signal lines 17 which is driven (controlled) by the gate driver ICs (circuits) 12 has low impedance. Accordingly, the above applies to the compositions or structures of the gate signal lines 17.

In particular, it is preferable that LTPS is employed. The LTPS can be used to form N-channel and P-channel transistors having a top gate structure and a small parasitic capacitance. The copper line or copper alloy line process can be employed in processes. It is preferable that a three-layer structure of Ti—Cu—Ti is employed for the copper line.

For the lines, it is preferable that a three-layer structure of Mo (molybdenum)-Cu—Mo is employed in the case of transparent amorphous oxide semiconductors (TAOS).

As described above, the embodiments have been presented as exemplifications of the techniques according to the present disclosure. The attached drawings and the detailed descriptions are provided for that purpose.

Accordingly, the structural elements described in the attached drawings and the detailed descriptions may include not only the structural elements which are essential for solving the problems but also the structural elements which are not essential for solving the problems but used for exemplifying the above-described techniques. As such, description of these non-essential structural elements in the accompanying drawings and the detailed descriptions should not be taken to mean that these non-essential structural elements are essential.

Furthermore, since the foregoing embodiments are for exemplifying the techniques according to the present disclosure, various changes, substitutions, additions, omissions, and so on, can be carried out within the scope of the Claims or its equivalents.

INDUSTRIAL APPLICABILITY

The present disclosure can be used to an EL display device (EL display panel) and a method for driving the same. Specifically, the present disclosure can be used to, for example, a video camera, a digital camera, a head mounted display, a navigation system, an audio reproducing device (a car audio, an audio component, etc.), a computer, a gaming device, a mobile information terminal (a mobile computer, a mobile phone, a mobile game device, a digital book, etc.), an image reproducing apparatus including a recording medium (to be specific, a device including a display capable of reproducing a recording medium of a digital versatile disc (DVD) or the like and displaying the image thereof), etc.

REFERENCE SIGNS LIST

11*a* driving transistor (TFT)
11*b* second switching transistor
11*d* first switching transistor
12*a*, 12*b* gate driver IC (circuit)
14 source driver IC (circuit)
15 EL element
16 pixel
17*a*, 17*b*, 17*c*, 17*d* gate signal line
18 source signal line
19*a* capacitor
20 display screen
41 current detecting circuit (current amount obtaining circuit)
43 on-voltage generating circuit
70 control circuit (control voltage generating circuit)
70*a* FB control line
121 scanning and output buffer circuit
123 input terminal
131 switching circuit
151 EL display panel (EL display device)
152 casing
153 holding base
161 shutter
162 view finder
163 cursor
171 keyboard
172 touch-pad
191 operational circuit (current amount obtaining circuit)

The invention claimed is:

1. An electroluminescent (EL) display device comprising:

a display screen including a plurality of pixels arranged in rows and columns;

a first gate signal line and a second gate signal line which are disposed for each of the rows of the plurality of pixels;

a gate driver circuit which outputs a first control voltage to the first gate signal line and a second control voltage to the second gate signal line;

a current generating circuit which supplies a current to the plurality of pixels of the display screen;

a current amount obtaining circuit which obtains a magnitude of a current flowing through the display screen; and a control voltage generating circuit which generates the first control voltage output by the gate driver circuit to the first gate signal line, wherein each of the plurality of pixels includes:

an EL element;

a driving transistor which supplies a driving current to the EL element;

a first switching transistor disposed in a path of the driving current, the first switching transistor having a voltage applied across a channel and adjusted based on the first control voltage supplied from the first gate signal line; and a second switching transistor which switches between a conducting state and a non-conducting state based on the second control voltage supplied from the second gate signal line, the second switching transistor applying a video signal to the driving transistor, wherein the current amount obtaining circuit obtains the magnitude of the current flowing through the display screen by performing an operation on video data input to the display screen, the operation being performed on the video data before the video data is input to the display screen, wherein, when the current amount obtaining circuit detects the magnitude of the current increases, the control voltage generating circuit decreases a magnitude of the first control voltage, which is output by the gate driver circuit to the first gate signal line, in order to increase the voltage applied across the channel of the first switching transistor to thereby decrease current flowing through the EL element and lower a peak luminance of light emission, and wherein, when the current amount obtaining circuit detects the magnitude of the current decreases, the control voltage generating circuit increases the magnitude of the first control voltage, which is output by the gate driver circuit to the first gate signal line, in order to decrease the voltage applied across the channel of the first switching transistor to thereby increase the current flowing through the EL element and increase the peak luminance of light emission.

2. The EL display device according to claim 1, wherein the second control voltage includes an on-voltage for turning on the second switching transistor, and a plurality of off-voltages for turning off the second switching transistor.

3. The EL display device according to claim 1, wherein the current amount obtaining circuit is between a voltage source and the first switching transistor.

4. The EL display device according to claim 3, wherein the current amount obtaining circuit includes a current detecting resistor and a differential amplifier for detecting a voltage generated across the current detecting resistor due to the current flowing through the display screen.

5. The EL display device according to claim 4, wherein the differential amplifier generates a voltage value by amplifying the current flowing through the plurality of pixels by a predetermined amount according to the current flowing through the plurality of pixels, and the current amount obtaining circuit further includes a third switching and a second amplifier that adjust the voltage value generated by the differential amplifier to match the first control voltage in a subsequent stage.

6. The EL display device according to claim 5, wherein an increase in the current flowing through the plurality of pixels increases an output voltage of the second amplifier of the current amount obtaining circuit, and a decrease in the current flowing through the plurality of pixels decreases an output voltage of the second amplifier of the current amount obtaining circuit.

7. The EL display device according to claim 1, wherein the display screen is divided into a plurality of sections, the current amount obtaining circuit obtains the magnitude of the current flowing through the display screen for each of the plurality of sections, and the control voltage generating circuit adjusts the magnitude of the first control voltage for each of the plurality of sections based on the output result from the current amount obtaining circuit for each respective one of the plurality of sections.

8. The EL display device according to claim 7, wherein each of the plurality of sections includes a plurality of pixel rows.

9. The EL display device according to claim 7, wherein each of the plurality of sections includes a pixel row.

10. The EL display device according to claim 7, wherein each of the plurality of sections includes a pixel.

11. A method for driving an electroluminescent (EL) display device including a display screen including a plurality of pixels arranged in rows and columns, each of the plurality of pixels including an EL element, a driving transistor which supplies a current to the EL element, and a switching transistor disposed in a path of the current flowing through the EL element, the method comprising:

obtaining a magnitude of a current flowing through the display screen by performing an operation on video data input to the display screen, the operation being performed on the video data before the video data is input to the display screen; and varying a magnitude of the current by adjusting a value of a voltage applied to a gate terminal of the switching transistor, wherein, when the magnitude of the current increases, the magnitude of the first control voltage, which is applied to the gate terminal of the switching transistor, is decreased in order to increase a voltage applied across a channel of the switching transistor to thereby decrease current flowing through the EL element and lower a peak luminance of light emission, and wherein, when the magnitude of the current decreases, the magnitude of the first control voltage, which is applied to the gate terminal of the switching transistor, is increased in order to decrease the voltage applied across the channel of the switching transistor to thereby increase the current flowing through the EL element and increase the peak luminance of light emission.

12. The method according to claim 11, wherein the EL display device includes a current amount obtaining circuit, and in the varying, the voltage applied to the gate terminal of the switching transistor is varied based on the obtained magnitude of the current.

13. The method according to claim 11, wherein the EL display device includes a current amount obtaining circuit, and in the obtaining, the current amount obtaining circuit obtains the magnitude of the current flowing through the display screen to vary, in the varying, the value of the voltage applied to the gate terminal of the switching transistor.

* * * * *